United States Patent [19]

Kasamura et al.

[11] Patent Number: 4,841,329

[45] Date of Patent: Jun. 20, 1989

[54] DEVELOPING DEVICE ACCOMMODATING APPARATUS AND IMAGE FORMING APPARATUS AND DEVELOPING DEVICE

[75] Inventors: Toshirou Kasamura, Yokohama; Masafumi Takagi; Naoki Okuda, both of Kawasaki; Masashi Ohashi; Toshihiko Kusumoto, both of Tokyo; Nobukazu Sasaki, Yokohama; Yasunori Maeda, Inagi; Masamichi Ikeda, Yokohama, all of Japan

[73] Assignee: Canon Kabushiki Kaisha, Tokyo, Japan

[21] Appl. No.: 116,957

[22] Filed: Nov. 5, 1987

[30] Foreign Application Priority Data

| | | | |
|---|---|---|---|
| Nov. 7, 1986 | [JP] | Japan | 61-265096 |
| Nov. 18, 1986 | [JP] | Japan | 61-274584 |
| Dec. 26, 1986 | [JP] | Japan | 61-313178 |
| Mar. 10, 1987 | [JP] | Japan | 62-52915 |
| Mar. 10, 1987 | [JP] | Japan | 62-52927 |

[51] Int. Cl.[4] ..... G03G 15/06

[52] U.S. Cl. ..... 355/245; 355/326; 118/645; 118/656

[58] Field of Search ..... 355/3 DD, 4, 14 D, 10; 118/645, 656–658, 661

[56] References Cited

U.S. PATENT DOCUMENTS

| | | | |
|---|---|---|---|
| 3,797,930 | 3/1974 | Tanaka et al. | 355/4 |
| 3,958,876 | 5/1976 | Terashima | 355/4 |
| 3,981,576 | 9/1976 | Inoue | 355/4 |
| 4,014,608 | 3/1977 | Terashima | 355/4 |
| 4,097,139 | 6/1978 | Hauser | 355/4 |
| 4,542,979 | 9/1985 | Percic | 355/4 |
| 4,705,394 | 11/1987 | Watanabe | 355/4 |

FOREIGN PATENT DOCUMENTS

| | | | |
|---|---|---|---|
| 57-204566 | 12/1982 | Japan | 355/4 |
| 57-204567 | 12/1982 | Japan | 355/4 |
| 60-067970 | 4/1985 | Japan . | |
| 61-063866 | 4/1986 | Japan . | |

*Primary Examiner*—R. L. Moses

*Attorney, Agent, or Firm*—Fitzpatrick, Cella, Harper & Scinto

[57] ABSTRACT

An image forming apparatus includes accommodating assembly for accommodating a plurality of developing devices on stages arranged substantially vertically and having first driving mechanism for moving the developing devices in a substantially horizontal plane, an image formation assembly for receiving selected one of the developing devices moved out of the accommodating assembly and for further moving it in a substantially horizontal plane, the image formation assembly including systems for forming images using the developing device, the accommodating assembly further including an opening for allowing a the developing device to be loaded into the accommodating assembly.

31 Claims, 20 Drawing Sheets

DEVELOPING DEVICE ACCOMMODATING APPARATUS AND IMAGE FORMING APPARATUS AND DEVELOPING DEVICE

FIELD OF THE INVENTION AND RELATED ART

The present invention relates to an apparatus for accommodating plural developing device for an image forming apparatus such as copying machine, recording machine and printer and to an image forming apparatus and a developing apparatus usable therewith, more particularly to such apparatuses wherein the developing device is detachably mountable into the image forming apparatus.

Conventionally, developing apparatus is set in place in an image forming apparatus such as a copying machine by an expert service operator, and thereafter, the user operator does not take the developing device out of the copying machine. Therefore, it has been dominant that a service man manually inserts the developing device into the assembly to a position, for example, a position where the developing device is near a photosensitive member but is not contacted to the photosensitive member, and then, a manual lever is operated to urge the developing device to the photosensitive drum to correctly position it with respect to the photosensitive member. This type is disclosed in U.S. Pat. Nos. 4,373,468 and 4,583,832, for example.

Recently, however, a new type of image forming apparatus becomes widely used wherein the developing device is replaceable with another developing device containing a different color toner such as red and blue in addition to black so as to permit image formation with a different color. With this trend, it is more frequent that the user operator himself mount the developing device into the apparatus or demounting it therefrom. This type is disclosed, for example, in U.S. Pat. Nos. 4,470,689, 4,500,195 and 4,575,221 wherein a process unit containing a photosensitive member and developing means is replaced; and U.S. Ser. No. 802,537 filed on Nov. 27, 1985 and assigned to the assignee of this application, wherein the apparatus contains two developing devices selectively usable, and wherein one of the developing devices is made exchangeable.

There is another proposal, as disclosed U.S. Ser. No. 844,718 filed on Mar. 27, 1986 and assigned to the assignee of the present application, wherein two developing devices are made selectively operable. Another proposal has been made in U.S. Pat. Nos. 4,615,612 and 4,622,916 wherein the apparatus has a turret type developer accommodating means.

However, since all of the above described system involves manual exchange or replacement of the developing device, it requires cumbersome work and involves the possibility that the developing device hitting the apparatus or the like, thus imparting unnecessary shock or vibration to the developing device.

On the other hand, considering the developing operation, the size of the developer particles becoming smaller in order to improve the image quality, more particularly the sharpness, with the result that the fluidability of the developer becomes higher when the developer is mixed with air. Therefore, it becomes required that the developing device is handle with great care, since otherwise the developer becomes distributed in the container non-uniformly, or the developer is scattered out.

Generally, the non-uniform distribution of the developer in the container is solved by stirring the developer, and in consideration of variations in the manner of handling by various users, the stirring period is made relatively longer to cover wide variations. Therefore, the time required until a first copy is obtained is long after the developing device is exchanged, or after the developer is supplied in the type of the device wherein the developing device is demounted from the apparatus to supply the developer. Where the developing device is limited by a stopper when the developing device is mounted into the apparatus, the degree of resulting non-uniform distribution of the developer and the scattering vary depending on the speed at which the user abuts the developing device to the stopper.

More particularly, in the system wherein the mounting of the developing device is performed by the user, the mounting operation is like closing a drawer by the user, and therefore, the shock imparted to the developing device is different depending on the user's peculiarity in the force of mounting it. If it is strong, the strong shock is applied in the longitudinal direction of the developing device (in the system wherein the developing device is inserted through a front door of the apparatus in a direction of a generating line of a photosensitive drum contained therein), the developer in the container becomes non-uniformly distributed in the longitudinal direction. And, the developer having been urged to the rear side may blow out through a clearance around a cover of the developing device to scatter out. Particularly, when the developer is replenished, a toner bottle containing a supply of developer to be replenished is shaked so as to increase the fluidability of the developer in order for the developer therein t be completely removed from the developer bottom into the container of the developing device. This makes the developer easy to scatter.

When the developing device is exchanged, the developer contained in the developer container in the developing device usually has been kept stationary for a relatively long period of time, and therefore, the fluidability is not so high. However, if it becomes once non-uniformly distributed, it is required that the developer is positively and relatively strongly stirred by stirring means such as stirring rod. Therefore, the time period for pre-rotation of the photosensitive member to prepare the apparatus for image forming operation, has to be longer. This also results in the longer time period to the first copy from the start of the copying apparatus.

From the users standpoint, various positioning means or other means have to be operated when the developing device is demounted or mounted, and therefore, it is cumbersome.

As a proposal to a solution to the above problems, five of the inventors of the present application have filed U.S. patent application Ser. No. 071,316 filed on July 9, 1987. The proposal contains, as a feature, a passage in the image forming apparatus to allow the developing device to be mounted into or demounted from the apparatus. A further proposal has been made in U.S. patent application Claiming the Convention Priority of Oct. 30, 1986. The proposal is a further improvement of this proposal in that a plurality of developing devices are accommodated and are set in place without requiring cumbersome manipulation by the users. The present invention is aimed at a further improvement in the stabilization of the horizontal and/or vertical movement and the manual loading of the developing device.

SUMMARY OF THE INVENTION

Accordingly, it is a principal object of the present invention to provide an apparatus for accommodating plural developing devices which allows loading of the developing devices without increasing the size of the image forming apparatus with which the accommodating apparatus is used.

It is a further object of the present invention to provide an apparatus for accommodating plural developing devices, which is loadable with the developing devices in good order.

It is a further object of the present invention to provide an apparatus for accommodating plural developing devices for maintaining the accommodation position in good order.

It is a further object of the present invention to provide an image forming apparatus which is usable with an apparatus for accommodating plural developing devices.

It is a further object of the present invention to provide a developing device which is suitably usable with an apparatus for accommodating plural developing device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
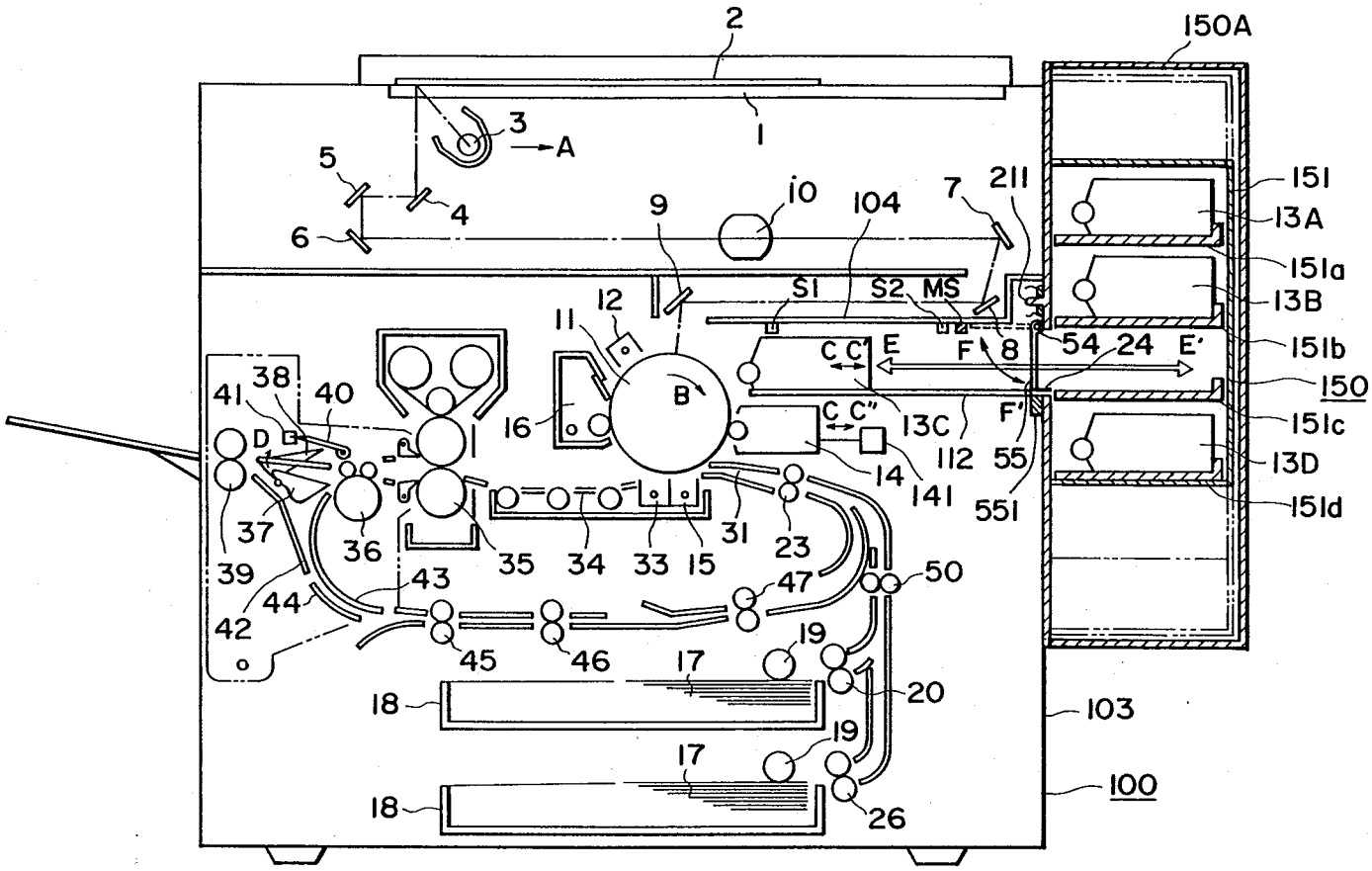
FIG. 1 is a sectional view of an image forming apparatus according to an embodiment of the present invention.

Referring to FIG. 1, there is shown an image forming apparatus, more particularly a copying machine in this example, used with an apparatus for accommodating plural developing devices according to an embodiment of the present invention. The exemplified image forming apparatus is capable of performing images on the opposite sides of a sheet in different colors and capable of forming superimposed images in different colors.

Before describing the developing device accommodating apparatus according to this embodiment, the image forming apparatus usable with the developing apparatus accommodating apparatus will be described.

In the image forming apparatus, an original 2 placed on an original supporting platen glass 1 is illuminated by a lamp 3, and the resulting image light is introduced onto a photosensitive drum (image bearing member) 11 by way of an optical system including a reflecting mirrors 4, 5, 6, 7, 8 and 9 and zoom lens 10. The lamp 3 and the mirror 4 and the mirrors 5 and 6 are moved at predetermined respective speeds in the direction indicated by an arrow A to scan the original 2. On the other hand, the photosensitive drum 11 is rotating in the direction indicated by an arrow B while being uniformly charged by a primary charger 12. When the light image is applied on the surface of the photosensitive drum 11 which has been thus electrically charged, an electrostatic latent image is formed in accordance with the original 2. Adjacent to the surface of the photosensitive drum 11, there are provided a chromatic color developing device 13C containing a chromatic color developer (green, for example) and a black developer 14 containing black developer. The developing devices 13C and 14 are movable in directions C and C′, respectively to access to the photosensitive drum 11 in accordance with selection of the color to develop the electrostatic latent image on the photosensitive drum 11 into a visualized image. FIG. 1 is shown as the chromatic developing device (green developing device, for example) 13C being disposed away from its operative position, while the black developing device 14 being in its operative position close to the photosensitive drum 11, so that a black image can be formed on the photosensitive drum 11. The developed image is transferred onto a sheet of paper (recording medium) by a transfer charger 15. Thereafter, the surface of the photosensitive drum 11 is conveyed to the cleaning means which is a cleaning station 16 where the remaining toner is removed from the surface of the photosensitive drum 11, so that it is prepared for the next image forming operation. The sheet 17 is fed in the following manner. There are several types of supplying means for supplying the sheet 17 to an image forming station including a photosensitive drum 11. In a first type, the sheet 17 accommodated in an upper cassette 18 is fed to the roller couple 12 by a pickup roller 19. The roller couple 17 is effective, when two or more sheets 17 are fed out, to separate the topmost sheet 17 and supply it to the image forming station. The sheet 17 having passed through the roller couple 20 advanced to a registration roller 23 by way of guiding plates, feeding roller couple 50 and additional guiding plates. In the second type, the sheet 17 accommodated in the lower cassette 18 is fed to a roller couple 26 by a pickup roller 19, in the similar manner as described above. The registration roller 23 once stops the coming sheet 17 and starts to rotate in timed relationship with the developed image formed on the photosensitive drum 11 to align the image with the sheet. After the start of the registration roller 23 rotation, the sheet 17 is advanced to the surface of the photosensitive drum 11 by way of a top guide 31 and a bottom guide 32. The sheet 17 receives the image from the photosensitive drum 11 by the operation of a transfer charger 15. The sheet 17 is then separated from the surface of the photosensitive drum 11 by the separating charger 34 and is further advanced through the conveying passage 34 to an image fixing device 35 which contains a heating roller and a pressing roller. By the fixing device 35, the sheet 17 is heated and pressed so that the image on the sheet 17 is fixed into a permanent image. Thereafter, the sheet 17 is transported to a first discharge roller 36 and is further transported to a second discharging roller 39 by a flappers 37 and 38, by which it is discharged out of the apparatus. In this Figure, the flapper 38 is shown as closing the sheet passage, but since the flapper 38 is made of a light and soft material, and therefore, is flexible in the direction indicated by an arrow D, the flapper 38 is raised by the leading edge of the sheet 17 when it passes, so that the flapper 38 does not obstruct the passage of the sheet 17.

Next, the description will be made with respect to the flow of the sheet 17 in duplex image formation mode and superimposing image formation mode When the duplex image formation mod is selected in the image forming apparatus (images are to be formed on the opposite sides of the sheet 17), the sheet 17 is transported in the same manner as described above (simplex image formation mode) so that an image of the original is transferred and fixed on one side (the first side) of the sheet. The sheet is transported to the second discharging roller 39 and is further advanced thereby to an unshown tray. During this transportation, the trailing edge of the sheet 17 is detected by a sheet detecting mechanism comprising a detecting lever 40 and a photosensor 41, and after a predetermined time elapses (i.e. the time period until the trailing edge of the sheet 17 passes under the flapper 38), the second discharging roller 39 starts to reversely rotate so as to reinsert it into the apparatus. The sheet 17 is transported back with the then trailing edge leading, along the flapper 38, a left side inclined surface of the flapper 37 and the guiding plate 42. Further, it is transported by way of the guiding plate 43 and 44 and is advanced to the roller 45 with its facing orientation reversed. The sheet 17 is further advanced to a lateral registration roller 47 through a roller 46. At this time, the lateral registration roller 47 is at rest, so that the leading edge of the sheet 17 abuts the nip of the rollers 47, and thereafter, the roller couples 45 and 46 stop. When an image forming signal for the second side is produced, the lateral registration roller 47 starts to rotate so as to supply the sheet 17 along guiding plates. Prior to the sheet 17 reaching the registration roller 23, a lateral edge of the transfer sheet 17 is detected by a photosensor, and the lateral registration roller 47 corrects the lateral position of the sheet 17 in the direction perpendicular to the movement direction of the sheet 17, that is, perpendicular to the sheet of drawing, so as to align the lateral edge with the lateral edge position at the first image formation. The operations after the sheet 17 reaches the registration roller 23 are similar to the simplex image forming operations as described above. After an image is formed on the second side of the sheet 17, the sheet is discharged to the outside tray by the second discharging roller 39.

When a superimposing image formation mode is selected in that image forming apparatus, the first image formation operation is the same as the image formation in the simplex mod described hereinbefore. After the image formation on the first side, the flapper 37 is placed at a position indicated by broken lines, and therefore, the sheet 17 is discharged by the first discharging roller 36 and is transported to the guides 42 and 43 along the right side inclined surface of the flapper 37. Further, it is conveyed to the roller 45 along the guides 43 and 44 Then, the sheet 17 reaches the lateral registration roller 47 by a roller 46. When a predetermined period of time elapses after the trailing edge of the sheet 17 is detected by the detecting lever 40 and the photosensor 41, the flapper 37 is reset to the solid line position. When the second image formation signal is produced, the lateral registration roller 47 starts to rotate. The lateral shifting of the sheet 17 is the same as the case of the second side image formation in the duplex image forming operation. After the second image is formed on the transfer sheet 17, it is discharged to the tray outside of the machine by the second discharging roller 39. The foregoing explanation has been made as to the case where two images are superimposed, but a greater number of images may be superimposed, in which the movements of the sheet are basically the same. Here, however, the resetting of the flapper 37 from the broken line position to the solid line position is performed only prior to the final image formation.

Now, description will be made as to the apparatus 150 for accommodating plural developing devices according to an embodiment of the present invention. The developing device accommodating apparatus 150 is optionally attached to an outside of the image forming apparatus 100, in this embodiment.

The accommodating apparatus 150 can be optionally be attached to an outside of the image forming apparatus 100 when a chromatic color image formation is desired using a chromatic color developing device other than black developing device which is fixed in the apparatus 100 in this embodiment. Then, a desired color developing device is conveyed and supplied to the neighborhood of the photosensitive drum 11 in the image forming apparatus 100.

The accommodating apparatus 150 includes as a main body an accommodating case 151 provided with partition bottom walls or stages 151*a*, 151*b*, 151*c* and 151*d* which are formed integral with the case 151. On the partition stages 151*a*, 151*b*, 151*c* and 151*d*, chromatic color developing devices containing different color toners, for example, a red developing device 13A containing a red developer, a blue developing device 13B containing a blue developer, a green developing device 13C containing a green developer and a brown developing device 13D containing a brown developer are placed and are movable away from the stages toward the image forming apparatus 100. In the example of state shown in FIG. 1, the green developing device 13C is not contained in the accommodating case 151, but is in the apparatus 100 adjacent to the photosensitive drum 11, which is ready for developing the latent image. The transportation or transfer of the chromatic color developing device (green developing device 13C) is performed by a developer transporting means X (means rotating in the direction of arrows E and E' in FIG. 2. The developing device is transported into the apparatus 100 through an openable shutter (inlet) provided in the image forming apparatus 100. The shutter 55 is rotatable about a shutter shaft 54 in the directions F and F', and when the color developer is transported into the apparatus 100, the shutter is retracted to the broken line position by an unshown solenoid or the like so as not to obstruct the transportation of the developing device.

Figure 6:
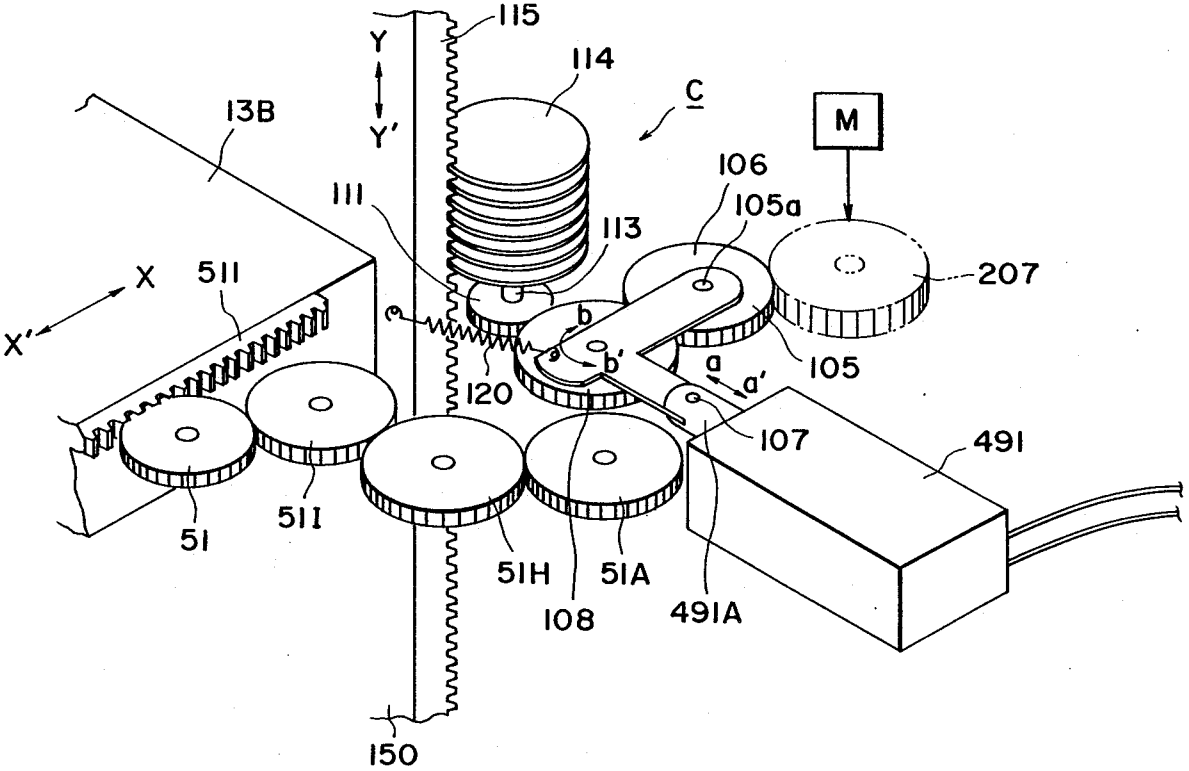
FIG. 6 illustrates relationship between drive for a vertical movement of the accommodating apparatus and drive for a horizontal movement (further embodiment).

The accommodating apparatus 150 is further provided with means for moving the case (FIG. 6 which will be described hereinafter). By the case moving means or belt moving mechanism, the accommodating case 151 as a whole is movable u and down relative to the apparatus 100. Therefore, one of the partition stages 151*a*–151*d* which accommodates the developing device containing the desired color is moved by the case moving means into alignment with the inlet of the image forming apparatus 100 constituted by the above described shutter 55 (in the example of the Figure, the partition stage 1X51*c* is in alignment). Thus, a desired developing device can be transported into the apparatus 100. For example, when the image forming apparatus selects the red developing device 13A, for example, the green developing device 13C then placed in the apparatus 100 is first transported back onto the partition stage 151*c* of the accommodating case 151 by the developing device moving means X shown in FIG. 2. During this back transportation, the shutter 55 is retracted to the broken line position i.e., the open position. When the green developing device 13C is accommodated back into the accommodating case 151, a discriminating means Z which will be described hereinafter in conjunction with FIG. 3 confirms the presence of the green developing device 13C in the case 151. When it is confirmed, the case moving means starts to shift the entire case 151 vertically relative to the apparatus 100 (in this case, downwardly) by the case moving means, and stops when the partition stage 151*a* supporting the desired red developing device 13A is brought into alignment with the inlet (shutter 55) of the apparatus 100. Then, the red developing device 13A is transported to the neighborhood of the photosensitive drum 11 by the developing device moving means X shown in FIG. 2, and therefore, it is placed readily for developing the latent image. The operation is the same when another color developing device in the accommodating case 151 is selected.

Front and rear plates 101 and 102 of the image forming apparatus 100 have slide guides 111 and 112 fixed thereto at insides to support and guide the color developing device from the accommodating case 151 to the photosensitive drum 11. The shutter shaft of the shutter 55 constituting the inlet of the apparatus 100 is fixed to the front and rear plates 101 and 102 at its opposite ends. When the shutter takes the closing position as indicated by solid lines in FIG. 1, the shutter is attracted to a magnet catch 551 provided on the apparatus 100 to maintain the closed state. On the other hand, when it takes the open position indicated by broken lines, an end of the shutter 55 is abutted to a stay 104 of the apparatus 100 to maintain the open state. At this time, the shutter is set attracted by an unshown solenoid or the like, as described hereinbefore. Adjacent a position where the shutter 55 abuts the stay 104, a microswitch MS is provided to detect the shutter 55 taking the open position.

A groove 13*a* is formed by ribs on an outside surface of the bottom wall of each of the chromatic color developing devices 13A, 13B, 13C and 13D to be engaged with a pressing roller of a driving arm which will be described hereinafter. The top wall of each of the developing devices is provided with an opening 13*b* for supplying the developer, which is covered by a cover 13*c*. Further, opposite end flanges of a developing sleeve 13*d* are provided with known rotatable abutting rollers for maintaining a predetermined clearance between the developing sleeve 13*d* surface and the photosensitive drum 11 surface Below one of slide guides 112, there is provided a driving arm 130 having a driving area to transport a selected color developing device from the accommodating case 151 to the neighborhood of the photosensitive drum 11 of the apparatus 100. The driving arm 130 is rotatable about a shaft 131 mounted perpendicularly to the slide guide 112. On the other hand, a long arm 132 is mounted to the color developer side and is provided at its one end with a pressing roller 134 which is mounted thereto by a pin and which is engageable with the slot 13*a* of the color developing device. To the other end of the arm 132, a worm wheel gear (sector gear) 135 is mounted. The worm wheel gear has a central shaft 131 and is projected out of a rear plate 102 through a opening provided therein. The worm wheel gear 135 is meshed with a worm gear 140 provided on the image forming apparatus 100 outside the rear plate 102. The worm gear 140 is operatively connected to a motor (DC motor) 142 reversely rotatable through a torque limiter 141. Further, outside the rear plate 102, there is provided a photointerruptor 145 to detect the amount of rotation of the arm 132. The photointerruptor 145 is effective to detect the current position of the arm 132 by detecting a slot or slots of a disk formed as a part of the driving arm 130.

The operation of the driving arm 130 will be described. When instructions to change the color, for example, from the green developing device 13C to the red developing device 13A, in the image forming apparatus, is produced, the motor 142 is released from the locking, whereby the twisting of the torque limiter 141 spring-charged is eased, so that the pressure by which the green developing device 13C is pressed toward the photosensitive drum 11 is released. Then, the motor 142 starts to rotate in the backward rotation so that the pressing roller 134 at the end of the arm 132 pushes the wall of the groove 13*a* on the bottom of the green developing device 13C so as to move the green developing device 130 in the direction E'. During this operation, the arm 132 swings. When the end thereof reaches the neighborhood of the shutter 55 then opened, the photointerruptor detects the slot of the disk. A predetermined period of time thereafter, the motor 142 stops. By those operations, the green developing device 13C is accommodated back into the partition stage 151*c* of the accommodating case 151. When it is accommodated back, the discriminating means Z shown in FIG. 3 confirms the existence of the green developing device 13C. Thereafter, the accommodating case 151 is moved vertically, more particularly, downwardly, by the case moving means such as a lack 115 and a worm gear 114 (FIG. 6), and when the partition stage 151*a* accommodating the red developing device 13A which is the desired developing device is brought into alignment with the inlet of the apparatus 100, it stops. Subsequently, the motor 142 starts to rotate in the forward direction, by which the arm 132 swings, so as to move the red developing device 13A in the direction E through the pressing roller 134. It is transported into the apparatus 100 through the shutter 55. The arm 132 rotates further, and when the pressing roller 134 reaches that edge of the movable range which is near the photosensitive drum, the slot of the disk actuates the photointerruptor to inform a control means of the image forming apparatus of the completion of the red developing device 13A transportation. For a predetermined period thereafter, the motor 142 continues to rotate, by which a spring of the torque limiter 141 is charged, and a pressure is urged to the pressing roller 134 at an end of the arm 132. Therefore, the red developing device 13A is contacted to the photosensitive drum 11 through spacer rollers mounted coaxially with the developing sleeve 13*d* to maintain a space between the developing sleeve 13*d* and the photosensitive drum 11.

Figure 3:
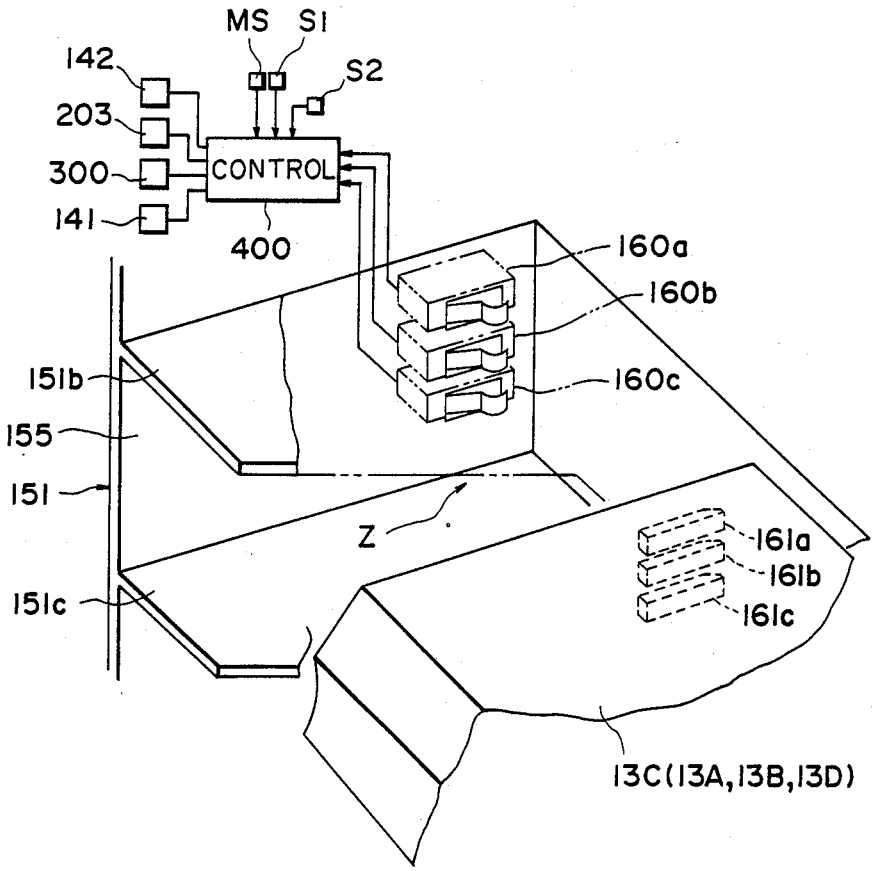
FIG. 3 is an enlarged perspective view of FIG. 1 apparatus.

Referring to FIG. 3, description will be made as to the discriminating means Z for discriminating a color of the developer contained in a particular color developing device when it is returned onto a predetermined partition stage of the accommodating means 151 by the developing device moving means X from the apparatus 100.

The discriminating means Z comprises color detecting switches (microswitch) mounted in the accommodating case 151 and a color detection projection provided in the color developing device. A rear wall 155 of the accommodating case 151 is provided with three color detecting switches 160*a*, 160*b* and 160*c* which are juxtaposed for each of the developing device accommodating portions constituted by the partition stages 151*a*–151*d*, respectively. Correspondingly, the rear wall of each of the color de eloping devices 13A, 13B, 13C and 13D is provided with three color detection projections 161*a*, 161*b* and 161*c* which are juxtaposed to actuate the color detection switches 160*a*, 160*b* and 160*c*, respectively. Therefore, when the color developing devices 13A, 13B, 13C and 13D are inserted sufficiently to a predetermined position in the developing device accommodating portions, the color detection projections 161*a*, 161*b* and 161*c* actuate color detecting switches 160*a*, 160*b* and 160*c*. In response to the signals from the detecting switches, the color of the developer contained in the color developing device is discriminated, simultaneously with the detection of presence or absence of the color developing device in the respective developing device accommodating portions.

In this example, the color and the presence-or-absence detections are carried out in this manner. The signals from the color detection switches 160*a*, 160*b* and 160*c* are represented by switches S1, S2 and S3, respectively, which signals are 0 when opened, and 1 when closed. The absence of the color developing device is detected by all the signals S1, S2 and S3 being 0. When S1=l, S2=0, S3=0, then it is discriminated that the developing device for red for example. Further, when S=1, S2=1 and S3=1, for example blue is discriminated, for example. Here, it is a matter of course that the color detection projections 161*a*, 161*b* and 161*c* are constructed so as to the above formula.

In this example, the color and the presence-or-absence of the color developing device are detected by cooperation between the three microswitches for color detection 160*a*, 160*b* and 160*c* provided in the developer accommodating portions of the accommodating case 151 and the three color detection projections 161*a*, 161*b* and 161*c* provided in the color developing devices 13A, 13B, 13C and 13D. However, the number of those switches are not limited to this example, but may be suitably selected by one ordinary skilled in the art. Further alternatively, the color detection switches may be of a photointerruptor type or the like in place of the microswitch type. What is required here is that the color discrimination and the presence-or-absence discrimination can be performed when the color developing device is accommodated in place in the developing device accommodating portions.

In this example, whether a color developing device is accommodated in place or not in the associated developing device accommodating portion is discriminated utilizing the color discriminating means. However, another type of discriminating device may be employed by one skilled in the art.

The developing device accommodating apparatus according to this embodiment is thus provided with the developing device detecting means for the respective developing device accommodating portions, and therefore, the following advantages are provided:

(1) The developing device accommodating apparatus is kept informed of which (color) developing devices are accommodated in which accommodating portions, and therefore, it is not necessary to input this information during an initializing stage of the operation. Furthermore, even if a temporary power shut down takes place, an undesired developing device is not selected, which otherwise may occur due to breakdown of the memory.

(2) It is possible to display which (color) developing devices are accommodated currently in which accommodating portions of the developing device accommodating apparatus, on the display of the image forming apparatus using the control system of the image forming apparatus. Also, it is easy to provide means for displaying which developing device is selectable from the accommodating apparatus, independently of the control system of the image forming apparatus.

(3) When a developing device is taken out, any care is not required as to the accommodating portions when it is reinserted.

(4) The signal produced by the developing device detecting means is taken as a signal representing that the developing device is completely returned, so that, for example, the signal is utilized for the next sequential operation control, for example, in response to this signal, the developing device moving means and the case moving means are controlled on the basis of this signal.

Figure 4:
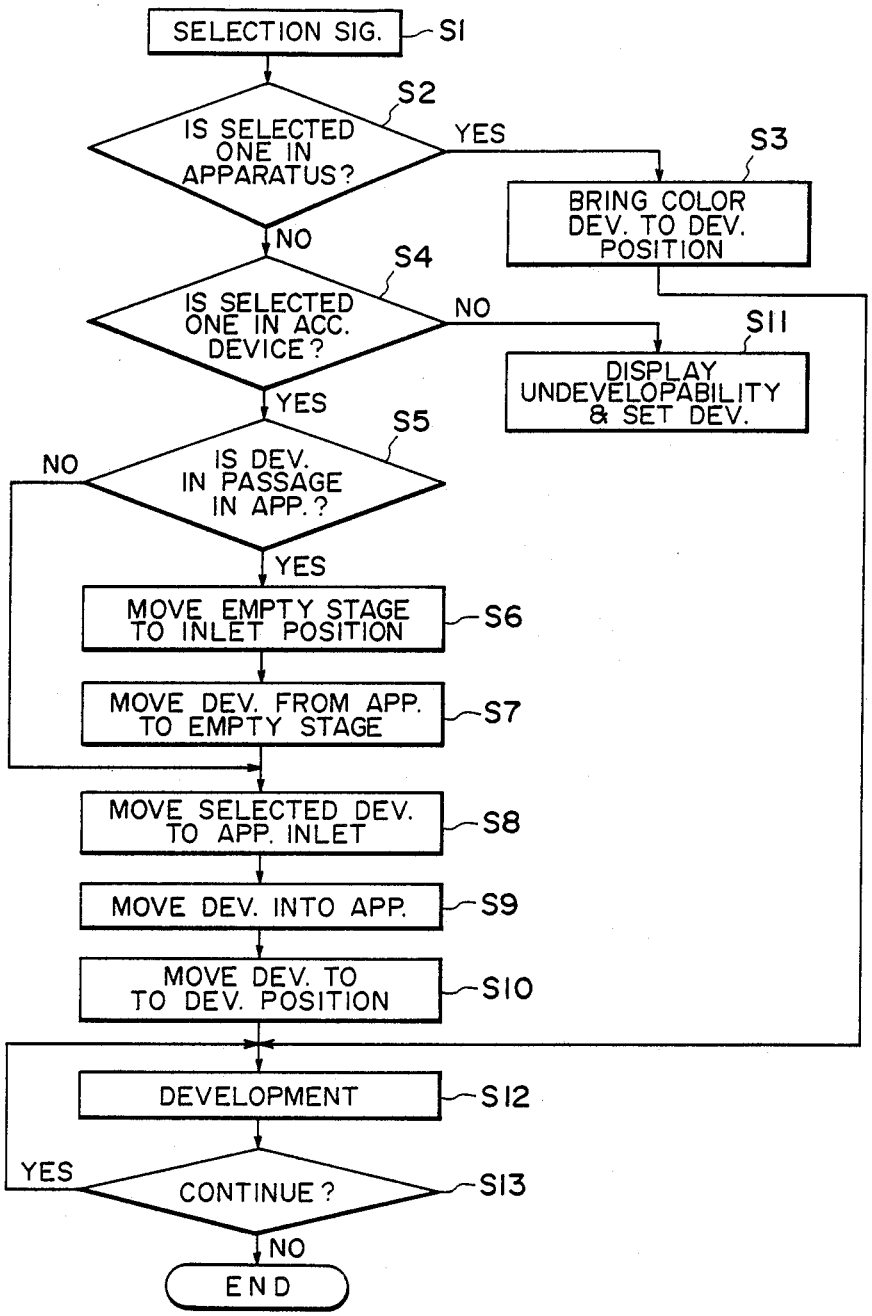
FIG. 4 is a flow chart illustrating a part of operations in the apparatus shown in FIG. 1.

Referring to FIG. 4, the color developing device supplying operations will be explained, which is performed under the control of an unshown control means of the image forming apparatus.

When a selection signal is inputted into the control means (step 1), discrimination is first made as to whether or not the selected color developing device is set in the apparatus 100 from the information provided by the discriminating means Z (step 2). When it is confirmed that the selected developing device is set in the apparatus 100 (yes), the sequence goes to step 3 where the color developing device is shifted to the operative position by the above-described developing device means X. If, on the other hand, it is discriminated that the selected color developing device is not in the apparatus 100 (no) by the sensors S1 and S2, the sequence goes to a step 4, where discrimination is made further as to whether or not the selected color developing device is in the developing device accommodating apparatus 150 from the information provided by the color discriminating means Z. When it is confirmed by the sensors S1 an S2 that the selected color developing device is in the developing device accommodating apparatus 150 (yes), the sequence goes to a step 5 where discrimination is made as to whether a color developing device is in the transportation passage in the apparatus 100 or not. If so, the sequence goes to a step 6 where an empty stage of the accommodating apparatus 150 is brought into alignment with the shutter 55 (inlet to the apparatus 100) by the case moving means Y, and then at step 7, the color developing device in the transportation passage of the apparatus 100 is accommodated back into the empty stage by the developing device moving means X, and subsequently at step 8, the selected developing device in the accommodating apparatus 150 is moved to the supply level by the case moving means Y. At step 9, the selected color developing device is supplied into the apparatus 100 from the accommodating apparatus 150. When the switch S1 detects that the selected developing device is now at the developing-stand-by position, the supplied color developing device is moved to the operative position at step 10. Here, at steps 9 and 10, the developing device moving means X operates. On the other hand, if at the step 4, it is discriminated that the selected color developing device is not contained in the accommodating apparatus 150 (no), the sequence goes to step 11 to display incapability of development and necessity of setting the developing device into the accommodating apparatus 150. If at step 5, it is discriminated that there is no color developing device in the passage of the apparatus 100, the sequence goes to step 8 where the selected color developing device in the accommodating apparatus 150 is moved to the supplying inlet.

Upon completion of execution at steps 3 and 10, the developing operation is performed at step 12; and at step 13, the necessity of continuing the operation is discriminated. If the necessity exist, (yes), the feedback control is executed, while if not (no), this routine ends.

The control means 400 is provided with an interface for transmitting a signal from the main apparatus 100 to the developing device accommodating apparatus 150 and for transmitting a signal from the accommodating apparatus 150 to the main apparatus.

As described in the foregoing, according to this embodiment, a developing device selected in accordance with a selection signal is automatically sent out of the developing device accommodating portion, and the developing device is automatically transported into the apparatus to place the image forming apparatus under the condition of performing the desired image forming operation, whereby the setting of the required developing device can be executed without resort to manipulation by the operator and with precision and high speed. In addition, it can be avoided for the apparatus to become bulky by being equipped with plural developing devices.

Figure 5:
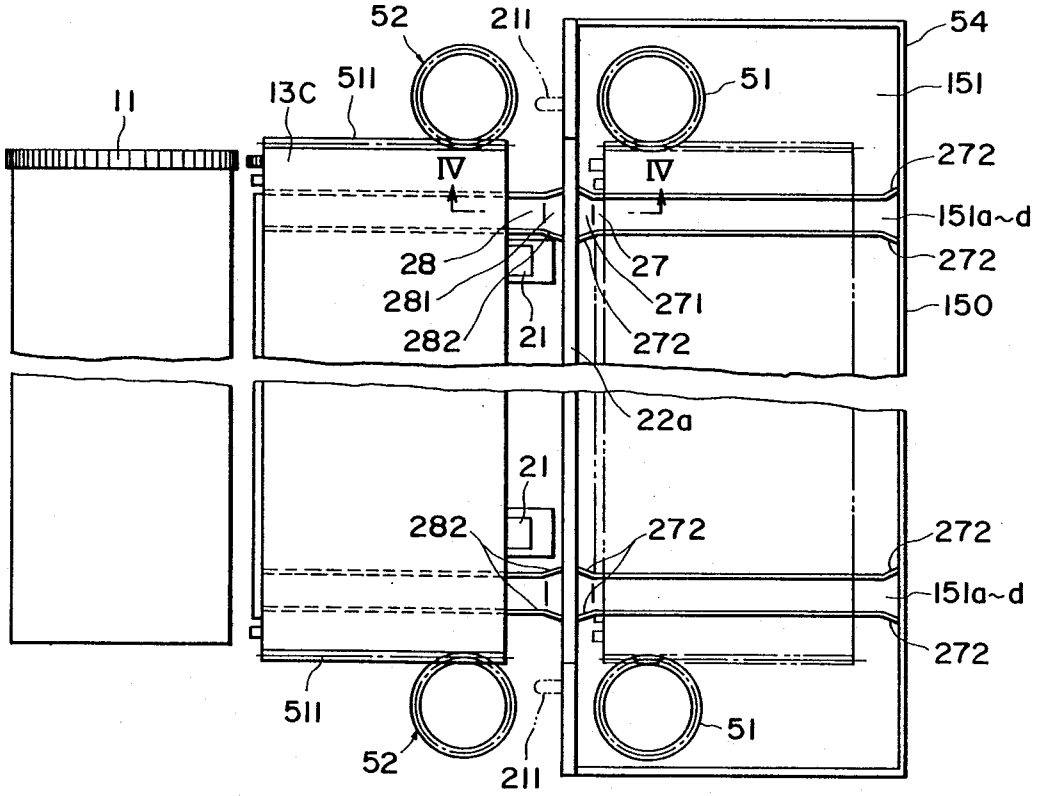
FIG. 5 is a top plan view illustrating another example.
Figure 7:
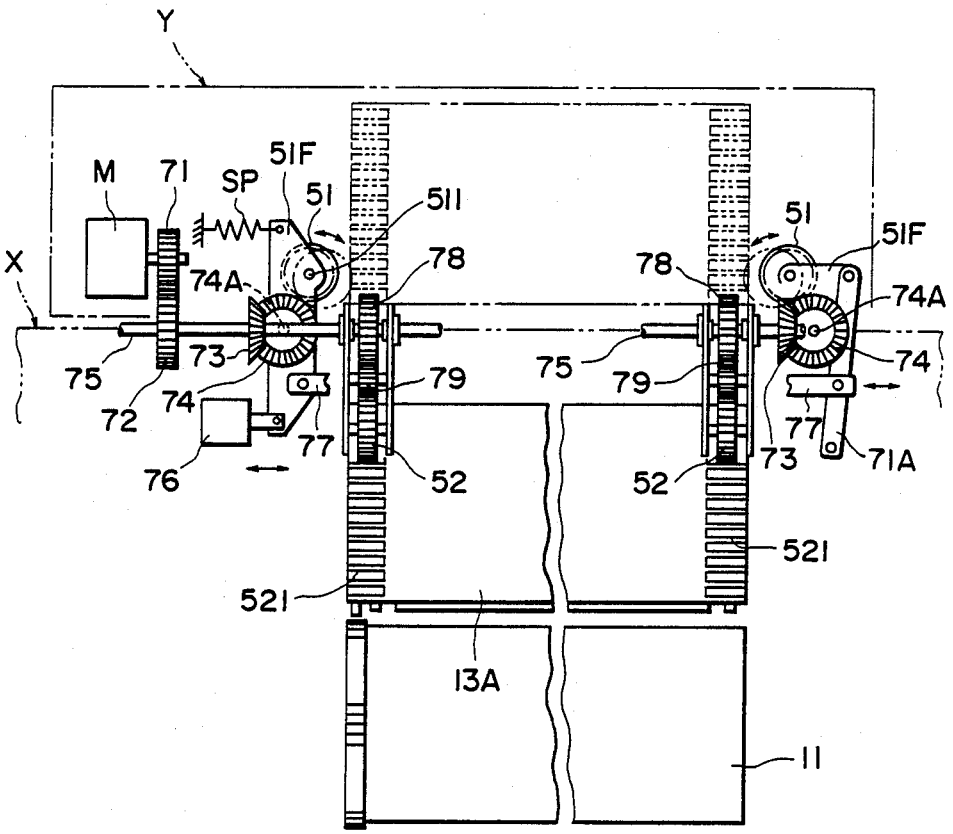
FIG. 7 shows a modification of FIG. 6 embodiment.

FIGS. 5–7 will be described in connection with FIGS. 1, 13 and 17.

The developing device accommodating apparatus 150 is provided with a developer supplying inlet **22*a* at predetermined inlet positions, a housing 150A secured to the main part 100 of the image forming apparatus and an accommodating case 151 substantially vertically movable by an unshown driving mechanism relative to the housing 150A. The front end (left side in this Figure) of the accommodating case 151 is opened, and the housing 150A functions also as a cover for the case 151**.

Figure 9:
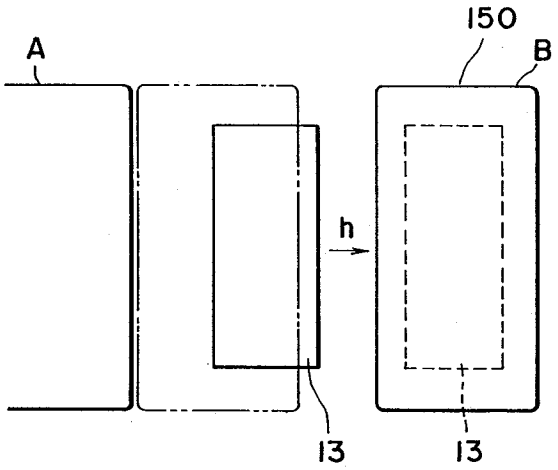

As shown in FIGS. 1 and 9 pins (engaging means) 211 and 211 are fixedly mounted to the base member 7 of the accommodating apparatus 150 at front and rear sides of the supplying inlet **22*a* to correctly position the developing device supplying inlet 6 relative to the developing device conveying passage in the vertical and horizontal directions. The pins 211 and 211** have tapered ends.

When the developing device accommodating apparatus 150 is to be mounted to the main part or body 100 of the image forming apparatus, the apparatus 150 is so positioned so that horizontal pins 211 are aligned with horizontal holes formed at both sides of the developing device inlet 2 in association with the pins 211, and then the apparatus 150 is moved so that the pins are engaged into the holes. Thereafter, the housing 150A is fixed to the main body 100 by disengageable fixing means such as both or the like.

In this manner, the supply port **22*a* of the developing device accommodating apparatus 150 is positioned with respect to the developing device inlet of the apparatus 100 with high precision. Therefore, a selected color developing device selected in the accommodating apparatus 150, i.e. the green developing device 13D in the illustrated example can be smoothly transported to the supply port by conveying means (a gear 51 meshed with the lack 511 of the developing device, and it is further smoothly transported from the inlet 22 to the operative position by the transporting means in the apparatus 100 (a gear 52 meshed with the lack 511 of the developing device), so that the desired developing device can be delivered to the operative position without problem. The pins 211 and holes 221** may be interchanged.

Referring to FIGS. 1 and 5 (651, 652, 661, 662 in FIG. 21), description will be made with respect to a structure (supplemental guide 24 and expanded ends of guide members) for obviating vertical and horizontal deviation when the developing device is transferred between the image forming apparatus 100 and the accommodating apparatus or when the developing device is loaded into the accommodating apparatus.

When guiding member engageable with the developing device to stabilize the loading thereof into the main part or into the accommodating apparatus, the developing device conveying operation can fail due to manufacturing error or instability.

To obviate this problem, the slide guides 28 for guiding projection **136*a–d* (FIG. 12) at the bottom surface of the apparatus 100 and the slide guides 27 of the accommodating case for guiding the projections are expanded to provide a wider sliding space at the respective connecting sides. Also, the developing device loading side 272 (right-hand side) is expanded. The slide guides 27 and 28 are in the form of a channel, and the lateral walls 272 and 282 and the bottom walls 281 and 271 of the channel are slanted to provide gradually expanding guide space. Therefore, even if there is a horizontal deviation and/or a vertical deviation between the slide guide 27 of the apparatus 100 and the slide guide 28 of the accommodating case 150**, the color developing device is positively guided by the inclined surface so that it can be transferred to the opposite apparatus with certainty.

Referring to FIG. 6, the description will be made as to driving means C for vertically driving the accommodating case 150 as a whole (in the direction indicated by Y-Y') and also for transporting a selected developing device 13B, for example toward the image forming station in a direction indicated by X-X'.

The driving means C includes a solenoid 491 which has a rod 491A movable in directions indicated by arrows a-a'. To a free end of the rod 491A, a swingable lever having a shape of 'L' is rotatably mounted on a pin 107. An end of the swingable lever 106 is journaled to a shaft 105*a* of the gear 105, and adjacent the other end of the lever 106, a gear 108 is mounted for rotation in a horizontal plane, the gear 108 being normally meshed with the gear 105. The gear 105 is meshed with the gear 207 receiving driving force from the driving gear.

Adjacent the gear 108, there are gears 111 and 51A which are rotatable in a horizontal plane and which are to be selectively meshed with the gear 108. A worm gear 114 is fixed to a rotational shaft supporting the gear 111 as shown in the Figure. The worm gear 114 is meshed with a rack 115 extending substantially vertical on an end of the developing device accommodating case 150 near the main body. The gear 51A is meshed with a gear 51 for moving the developing device in X-X' direction through the gears 51H and 51I which are rotatable in a horizontal plane. The gear 51 is meshed with a rack 511 formed on and projected from a side of the developing device 13B.

Figure 21:
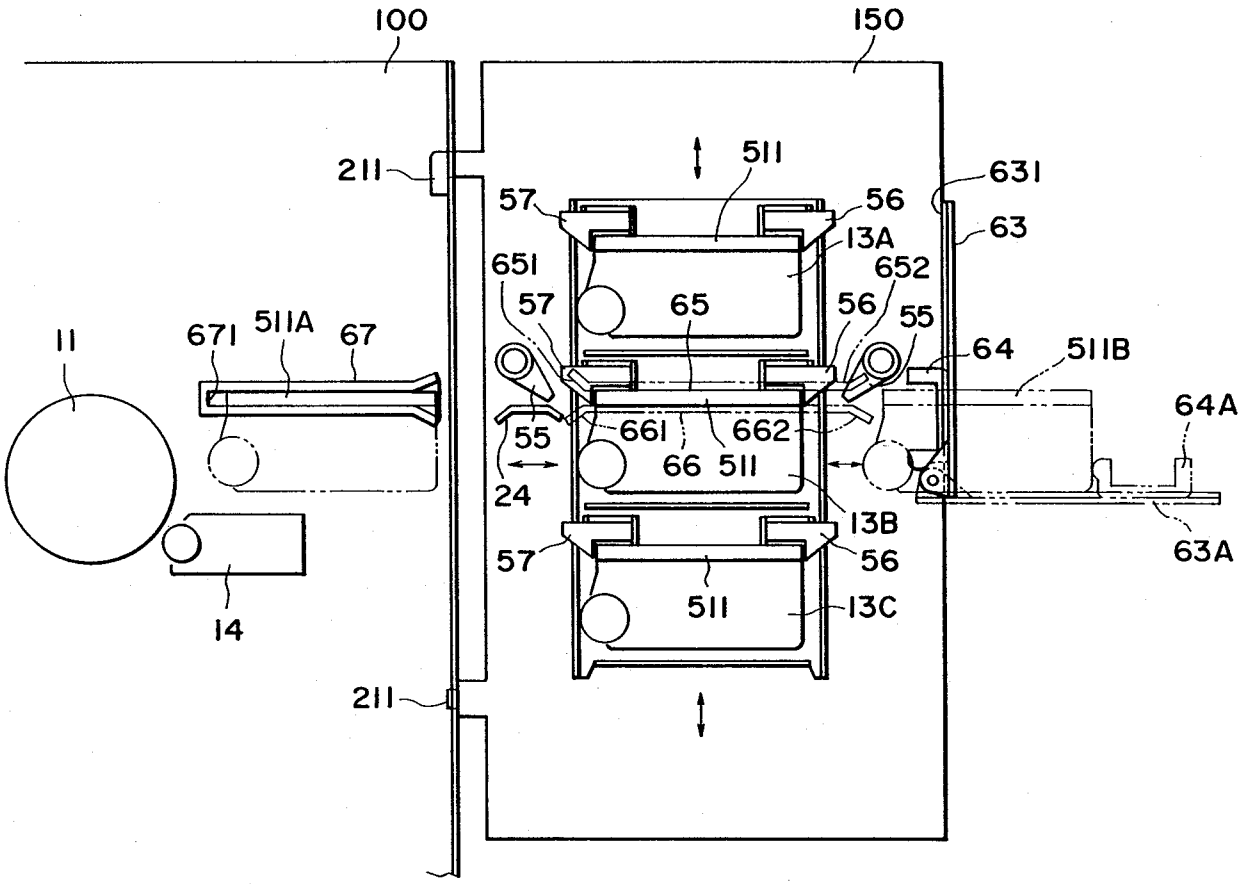
FIG. 21 illustrate a further preferable embodiment of the present invention wherein securing means, a developing device, releasing means and guiding means are shown.
Figure 22:
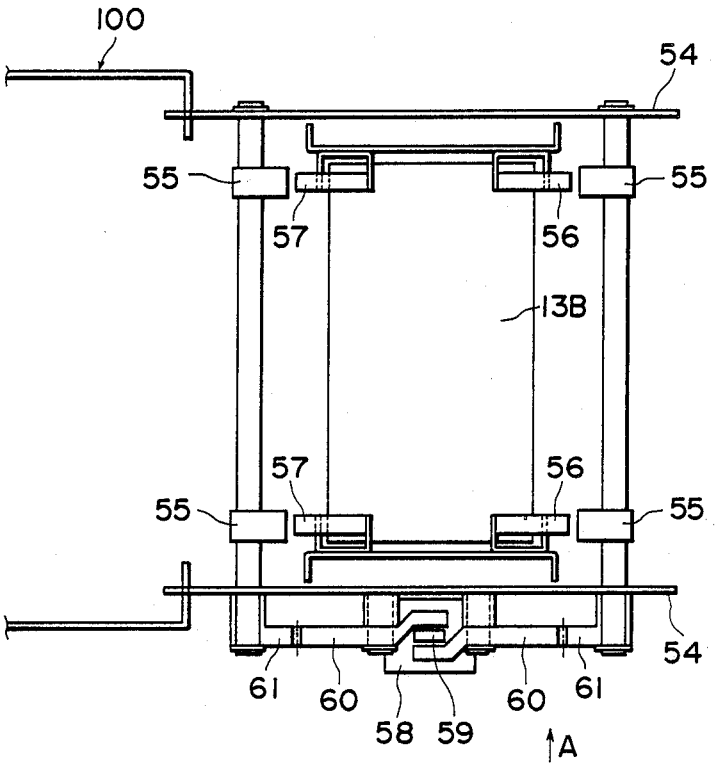
FIG. 22 is a top plan view of the device shown in FIG. 21.
Figure 23:
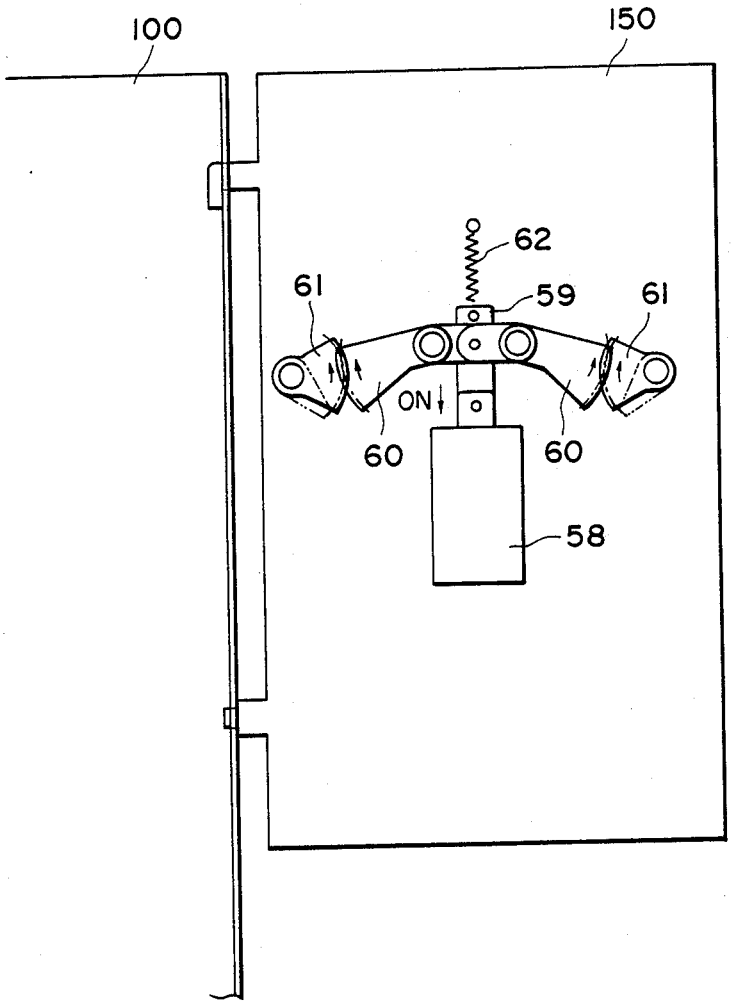
FIG. 23 illustrates operation of the apparatus shown in FIG. 22.

The swingable lever 106 is swingable about a shaft 105*a* of the gear 105 in the direction of b-b'. The swingable lever 106 is normally urged by a return spring 120 in the direction b, and when the solenoid is not energized, the gear 108 mounted thereto is meshed with the gear 111, as shown in FIG. 21.

Then the motor 208 is rotated in the forward direction by an unshown control means with the gear 108 shown in FIG. 6 meshed with the gear 111, the rotation of the motor is transmitted to the worm 114 through the gears 207, 204, 210, 206, 105, 108 and 111 and the shaft 113 to rotatingly drive the worm 114, by which the accommodating case 150 provided with the rack 115 meshed with the worm 114 is moved in Y direction, for example, upwardly. If the motor is reversely rotated, the accommodating case 150 moves in the Y' direction, that is, downwardly. In this manner, the accommodating case 150 is moved up and down, and therefore, one developing device having a desired color developer selected from the developing devices in the accommodating case 150 is brought to be opposed to an unshown developing device inlet of the main body X, by stopping the motor 493 at this position. Thereafter, the control means 400 of FIG. 3 drives the solenoid 491 to retract the rod 491A in the direction a'. Then, the swingable lever 106 swings about the shaft 105*a* in the direction B' together with the gear 108 against the spring force of the return spring 120, and the gear 108 is switched to be meshed with gear 51A from with the gear 111. When the motor 493 is rotated forwardly with this state, the rotation is transmitted to the X-driving gear 51 through the gears 207, 105, 108, 51A, 51H and 51I, so that the X-driving gear 51 is driven, by which the developing device provided with the rack 511 meshed with the X-driving gear 51 is transported in the direction X into the image forming station of the main body X of the image forming apparatus. If, on the other hand, the motor 493 is rotated reversely, the developing device accommodated in the apparatus 150 is transported back in the direction X' into the developing device accommodating case 150.

According to this embodiment, the developing device is not conveyed vertically and horizontally simultaneously. The developing device conveyance can be stabilized.

Referring to FIG. 7, there is shown a structure wherein the gear 51 of FIG. 6 is made completely separate from the drive of the driving motor M, and the vertical movement of the accommodating apparatus is driven by the motor M as in FIG. 6. Because of this structure, the driving motor can be made common to both apparatuses. Additionally, according to this example, the developing device can be moved correctly synchronously.

To transport the developing device to the image forming station in the neighborhood of the photosensitive drum 1 in the main body X of the apparatus, a couple of conveying means (left and right) Ma are provided. The description of the movement in the main part is omitted since that of FIG. 6 applies. To that one of the conveying means of the accommodating apparatus Y which is near the motor M, a DC motor M is fixed as a driving source, and the rotation of its output shaft is transmitted to a transmission shaft 75 through gears 71 and 72. The rotation of the transmission shaft 75 is transmitted to shafts 74A and 74A through bevel gears 73 and 73, 74 and 74 disposed at the respective sides, and is further transmitted to a gear 51 mounted to levers 51F through the gear at the lower position of FIG. 38. The lever 51F is mounted to the shaft 74A for rotation in a horizontal plane. To one end of one of the levers 51F, an operation rod of the solenoid 76 is mounted, whereas to the other end, a spring SP is mounted. To the other lever 51F, a link 77A is pivotably mounted adjacent an end thereof, and the other end of the link 77A is pivotably mounted to the accommodating apparatus Y. The link 77A and said one of the levers 51F is connected by a link 77.

In the middle of the transmission shaft 75, there are mounted left and right gears 78 and 78. The rotation of the transmission shaft 75 is transmitted to the gears 52 and 52 which are meshed with racks 521 and 521 formed on both sides of the top surface of the developing device 13A, through the gears 78 and 78 and gears 79 and 79. At both sides of each of the developing devices 13A, 13B and 13C, the similar racks are formed for engagement with the gears 51 and 51.

Upon operation of the solenoid 21, the gear 51 is brought to meshing engagement with the rack 511, and the DC motor M is actuated, and then the gears 51 and 52 at both sides are driven simultaneously. By this, the developing device is transported toward the image forming apparatus. When the leading end of the developing device 13A reaches the gears 52 and 52, the gears 52 and 52 are meshed with the racks 521 and 521, by which the transportation of the developing device 13A is continued until the developing device 13A is placed in position in the image forming station.

As described in the foregoing, according to this embodiment, a single driving source (DC motor M) may be used for driving plural driving means for conveying the developing device in synchronization.

In the foregoing description, the driving mechanism containing the DC motor (driving source) is disposed in the accommodating apparatus Y, but it may be disposed in the main body of the image forming apparatus, and the conveying means may be divided into the accommodating apparatus side mechanism and a main body side mechanism.

As for the driving source, a motor for this particular purpose may be utilized, or another motor in the main body X may be utilized in which case, the driving force is taken out as desired through a transmission mechanism such as a clutch or the like.

Referring to FIGS. 8–24, the description will be made with respect to the manual loading of the developing device into the accommodating apparatus 150, which is one of the features of the present invention. In the following embodiment, the above described developing device moving mechanism and the vertical movement mechanism for the accommodating case are employed when suitable.

In the conventional copying machine, the replacement of the developing device is performed on the side of the main part of the image forming apparatus which contains the image bearing member 11. However, where a developing apparatus accommodating apparatus for accommodating a plurality of developing devices, the operativity is not good if the developing devices are replaced or exchanged at the main part side, since the developing device has to be conveyed to the vacant part of the accommodating apparatus. Additionally, in this case, it is required to search the empty stage of the accommodating apparatus, which requires complicated control sequence, resulting in the higher possibility of malfunction.

It is desired, therefore, that the developing device can be exchanged or loaded into the image forming apparatus with good operativity. The present invention is intended to solve this problem. The fundamental concept thereof is to perform the developing device loading at the accommodating apparatus (150) side. The preferable structures for the loading and preferable structures for conveying the developing devices will be described.

Figure 8:
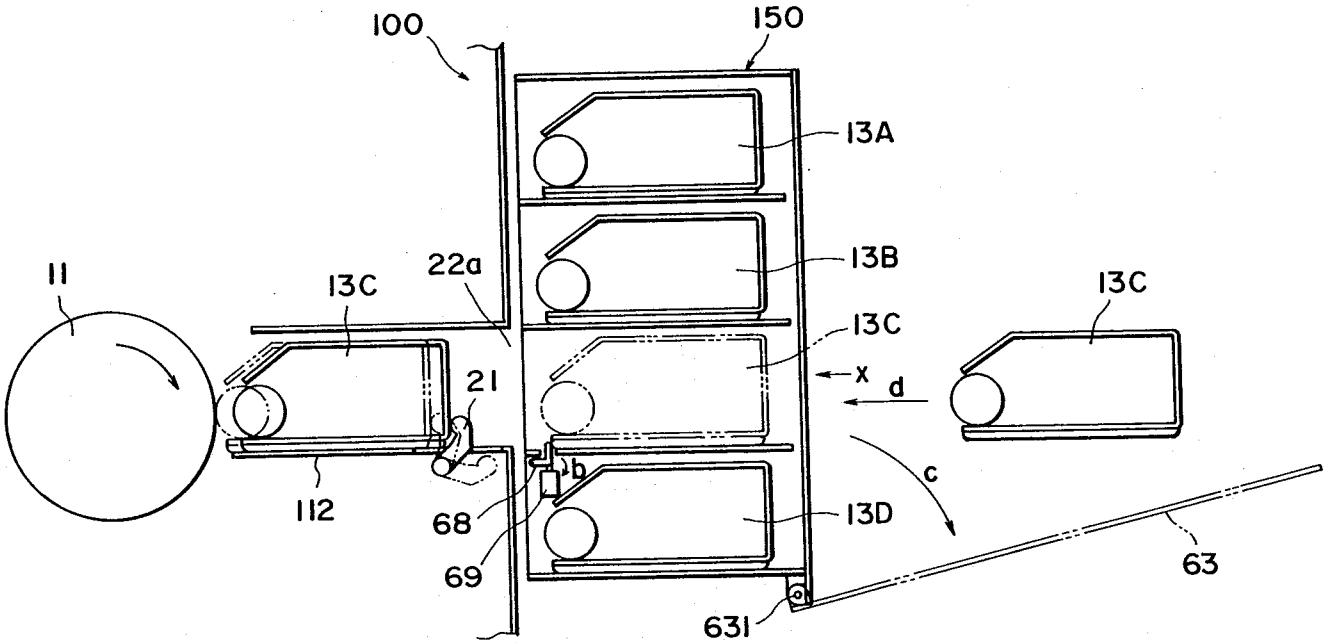
FIG. 8 illustrates loading of the developing device.
Figure 10:
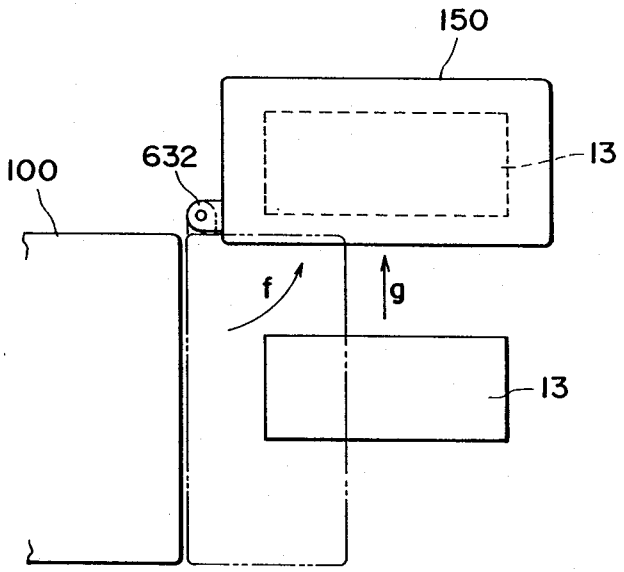
FIGS. 9–13 illustrate modifications of FIG. 8 structure.

In the arrangements shown in FIGS. 8–10, the direction of loading the developing device into the developing device accommodating apparatus 150 is substantially the same as the direction of loading the developing device into the main part of the image forming apparatus.

As shown in FIG. 8, the accommodating apparatus 150 is provided with a developing device inlet 22*a*, through which a conveying passage 112 is formed substantially horizontally to the photosensitive drum 11 in the main part 100 of the apparatus. The accommodating apparatus is further provided with locking means 8 and 69 for limiting movement of the developing device toward the photosensitive drum 11. The locking means includes an L-shaped lever 68 rotatably mounted on a fixed pin, resilient means (not shown) for maintaining the lever 68 at a position indicated by solid lines in FIG. 8 to lock the developing device, for example 13C, accommodated in the developing device accommodating apparatus at the position indicated by chain lines, and a solenoid 69 for pivotting in response to a predetermined signal the lever 68 about the fixed pin in the direction indicated by an arrow b to release the locking of the developing device 13C. The locking means 68 and 69 may be provided for each of the developing devices, or one set thereof may be provided for all the developing devices, in which case the set is disposed adjacent the conveying passage 112 to limit the developing device located therealong.

A cover 63 is mounted to a part of the developing device accommodating apparatus 150 for rotation about a supporting pin 631. When the developing device 13C, for example, is loaded into the accommodating apparatus 150, the cover 63 is rotated about the supporting pin 631 in the direction c (Figure 8) as shown by chain lines, then, the developing device 13C is loaded toward the photosensitive drum 1 in the direction indicated by an arrow d.

The cover 63 may be provided for each of the accommodating cavities of the developing device accommodating apparatus 150. The cover 35 may be transparent to allow the operator to look at the inside of the accommodating apparatus 150. As an alternative, the cover 35 has a color corresponding to the developer contained in the associated developing device 13A, 13B, 13C or 13D so as to clarify the positions for accommodating the developing devices 13A, 13B, 13C and 13D.

As shown in FIG. 8, the developing device 13C is stopped at the developing device inlet 22*a*. Then, if after the locking of the developing device 13C by the lever 68 is released by actuating the solenoid 69 the DC motor M (FIG. 7) is driven to rotate the gear 51 in the direction indicated by arrows in FIG. 1, the developing device 13C provided with the rack 511 meshing with the gear 51 is advanced toward the photosensitive drum, and the rack 521 of the developing device 13C is brought into meshing engagement with the gear 52 of the main part of the image forming apparatus. Thus, the developing device 13C is discharged from the developing device accommodating apparatus 150, and is conveyed to a stand-by position adjacent to the photosensitive drum 11 in the main part. When this is detected by the sensor S1 as shown in FIG. 1, the DC motor for driving the gear 52 is stopped. At this time, the pressing or urging arm 21 is at the position indicated by broken lines in FIG. 8, and when the developing device 13C comes to the solid line position, the arm 21 is rotated as shown by chain lines to push the rear part of the developing device 13C to press-contact the developing sleeve to the surface of the photosensitive drum 11 under a predetermined pressure (chain line developing position). Then, the developing device 13C is operative to develop an electrostatic latent image formed on the photosensitive drum 11 rotating in the direction indicated by the arrow.

In this embodiment, each of the developing devices 13A, 13B, 13C and 13D are loaded into the developing device accommodating apparatus 150 in the direction (d in FIG. 1) which is substantially the same as the direction of loading the developing device to the operative position. Therefore, there is no need of providing means for deflecting the moving direction to guide the developing device 13A, 13B, 13C or 13D to the image developing position, and therefore, the structure of the accommodating apparatus 150 can be simplified, be made lighter and be made inexpensive. Additionally, the manipulation of the developing devices 13A, 13B, 13C and 13D can be made easier.

FIGS. 9 and 10 illustrate other embodiments of the present invention, wherein the developing device accommodating apparatus 150 of the image forming apparatus is shown in a schematic plan view.

In the embodiment of FIG. 10, the accommodating apparatus 150 is rotatable by the hinge 632 like an openable door. When the developing device 13 is to be loaded into the accommodating apparatus 150, the accommodating apparatus 150 is rotated about the hinge 632 in the direction f to open it. Then, the developing device 13 is loaded in the direction g. It should be noted that the direction g is substantially the same as the direction of loading the developing device to the operative position.

In the embodiment of FIG. 9, the developing device accommodating apparatus 150 is translated in the direction h to shift it away from the main part, and the developing device 13 is loaded into the accommodating apparatus 150 in the direction h which is substantially the same as the direction of loading it into the main part of the apparatus.

According to those embodiments, the same advantages are provided as in FIG. 8 embodiment.

Figure 11:
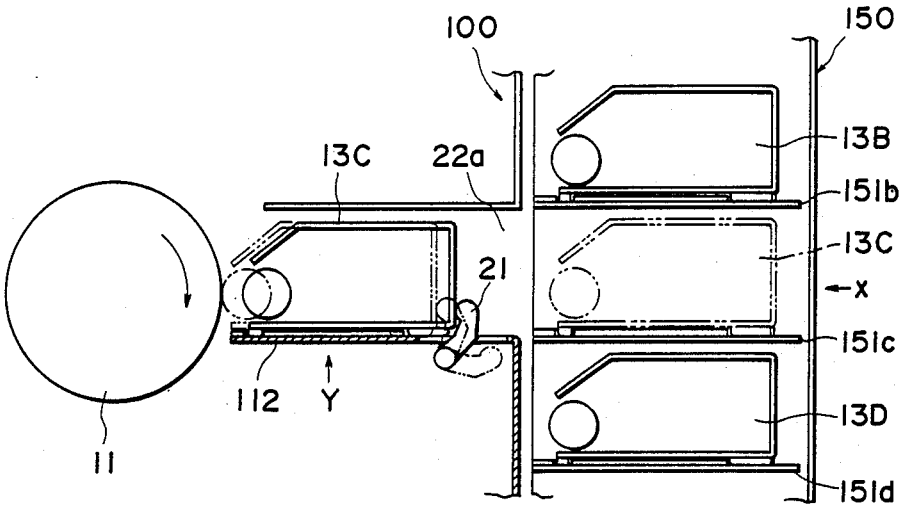
Figure 12:
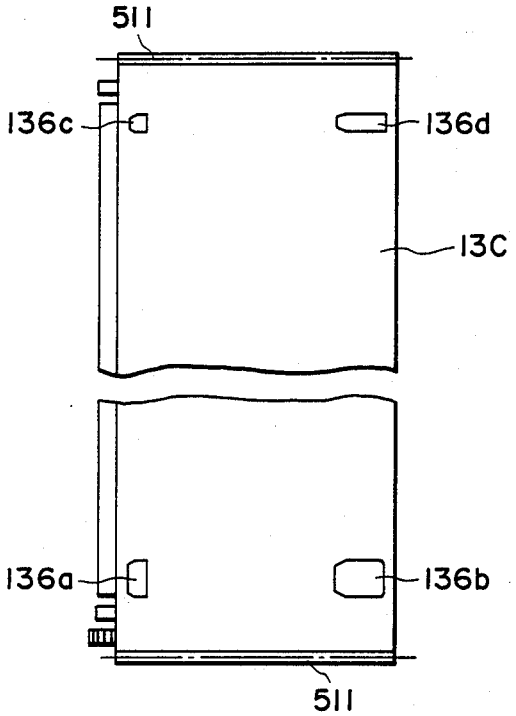
Figure 13:
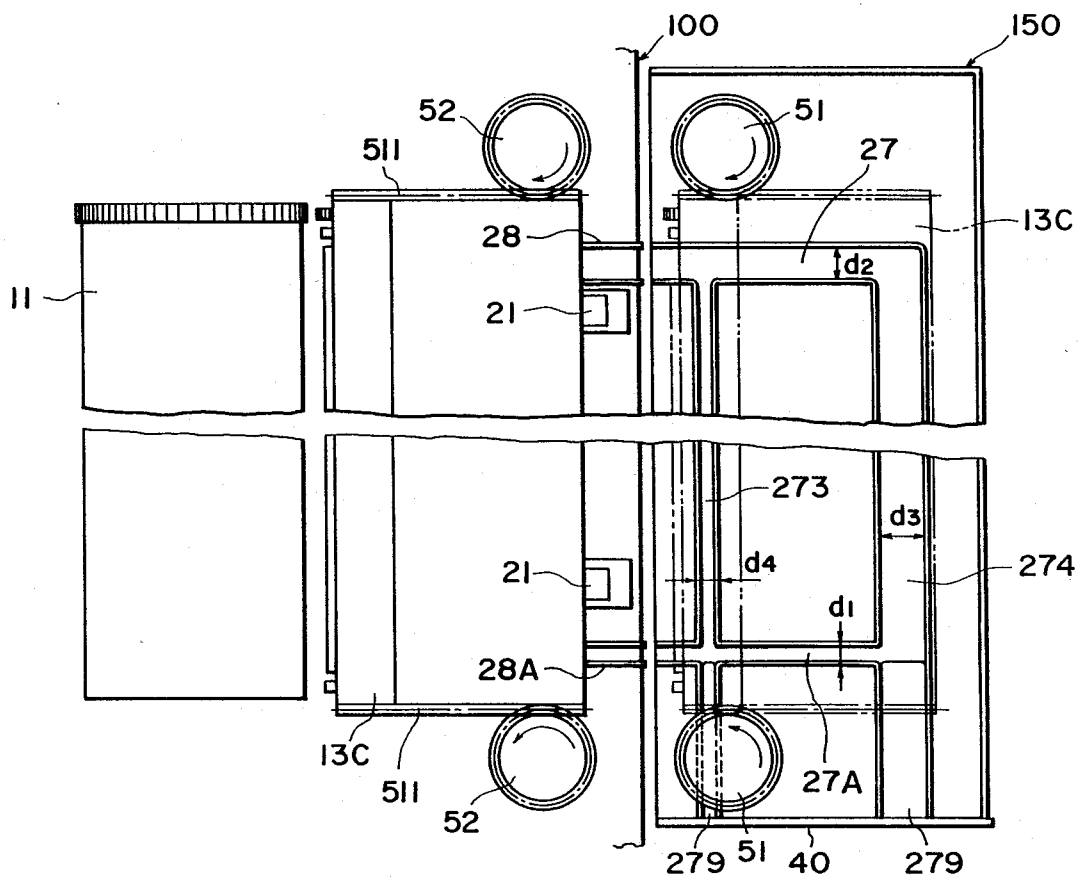

Referring to FIGS. 11–13, another embodiment of the present invention will be described, wherein the advantages of the developing device to be handled in the front side of the accommodating apparatus 150. In those Figures, specific structures of the guides are also shown. FIG. 13 is a top plan view like FIG. 5; FIG. 11 is a front view; and FIG. 12 shows a bottom plate of the developing device usable in this embodiment.

As shown in FIG. 13, a developing device supplying passage 112 is provided with guides 28A and 28 extending toward the photosensitive drum 11, which are spaced from and parallel to each other. Each of the partition stages 151*a*, 151*b*, 151*c* and 151*d* of the accommodating apparatus 150 is provided with guides 27A and 27 which can be made continuous with the guides 28A and 28 in the passage 112, and with developing device mounting guides 279 and 279 extending in a direction perpendicular to the guides 27A and 27. The guides 27A, 27, 279 and 279 have grooves having widths of $d_1$, $d_2$, $d_3$ and $d_4$, respectively, wherein the widths satisfy $d_1 > d_2$, $d_3 > d_4$.

The bottom surface of each of the developing devices 13A, 13B, 13C and 13D is provided, as shown in FIG. 12, with projections 136*a* and 136*b* engageable with the guides 28A and 28 and the mounting guides 279 and 279 and is provided with projected guiding members 136*c* and 136*d* engageable with the guides 28 and 27 and mounting guides 271 and 271.

On the insides of the guides 28A and 28 in the passage 112 in the main part 100 there is provided a cut-away portion or opening in the rectangular form. Through the cut-away portion, an urging or pressing arm 21 is movable.

The rack 511 of the developing device is formed projected from each side thereof as described hereinbefore in conjunction with FIG. 6.

The front side of the accommodating apparatus 150 (the bottom side in FIG. 13) is covered with a cover member 40 which has a "U" shape cross-section and which is detachably mountable to the apparatus 150, as shown in FIG. 13. To the cover 40, the above described DC motor M and guide stoppers 279 and 279 are fixed. The guide stoppers 279 and 279 are closely engaged with the mounting guides 273 and 274, and the free ends of the stoppers 279 and 279 are flush with the guides 27*a* so as to function together with the guide 27A to guide the guiding members 136*a*–130*d* formed projected from the bottom surface of the developing device 13C.

When one of the developing devices, for example, the developing device 13C is to be taken out of the accommodating apparatus 150, the cover member 40 is removed which is normally fixed by an unshown hook, and the cover member 40 is removed from the apparatus 150 together with the DC motor M and the gear 51 fixed thereto. The guide stoppers 279 and 279 (which are also effective to prevent the developing device from unintentionally coming off) are disengaged from the mounting guides 273 and 274. By pulling the developing device 13C, it can be taken out without difficulty and without detaching the accommodating apparatus 150 from the main part 100 of the image forming apparatus.

When the developing device 13C is to be mounted into the accommodating apparatus 150, the developing device 13C is pushed into the mounting guides 273 and 274, after the cover member 40 is removed. By this, the developing device 13C is easily loaded into the accommodating apparatus 150, and then the cover member 40 is mounted. As described, the loading mechanism for allowing the developing device to be loaded into the accommodating apparatus 150, is effective to avoid the above described inconveniences.

Referring to FIGS. 14, 15A, 15B and 15C, the description will be made with respect to the conveyance of the developing device accommodated in the accommodating apparatus 150 in the manner described above and the vertical movement thereof.

In the image forming apparatus disclosed in the hereinbefore mentioned prior application, each of the developing devices accommodated in the developing device accommodating apparatus is movable in the conveyance or supplying direction other than when the developing device is to be conveyed or supplied. Therefore, when the accommodating apparatus is operated or is subjected to an external vibration, the developing device or devices may be deviated from the predetermined position. If this occurs, the developing device can not be smoothly conveyed when it is to be conveyed to the development operative position. In the worst case, the developing device stops halfway in the conveying passage. The possibility of this occurrence has been confirmed by the applicants.

If the developing device reaches the operative position with the inclination uncorrected, the developing device possibly damages the photosensitive member. Also, if the position of the developing device is deviated in the accommodating apparatus to a relatively great extent, it is possible that the moving means is no longer able to convey the developing device to the development-operative position.

In the image forming apparatus where the developing device can be mounted into and dismounted from the developing device accommodating apparatus thereof, there is a problem that if the developing device position is deviated from the predetermined in the accommodating apparatus, the developing device could not be fed out. Further, in the apparatus wherein the developer can be supplied into the developing device contained in the accommodating apparatus, there are problems that the developer can not be supplied into the developing device and that the developer is scattered in the apparatus, if the deviation occurs.

This embodiment is intended to provide a solution to those problems. According to this embodiment, the developing device is prevented from moving in the conveying directions in the accommodating apparatus, by which the above described problems are effectively eliminated.

More particularly, the accommodating apparatus for accommodating a plurality of developing devices is provided with a stopper mechanism for preventing the developing devices from moving in the conveying direction and for releasing, as desired, the developing devices.

According to this embodiment, the developing devices are correctly positioned at the predetermined positions within the accommodating apparatus so that they can be smoothly conveyed to the operative position, and therefore, the problems such as damaging the image bearing member are effectively solved.

Figure 14:
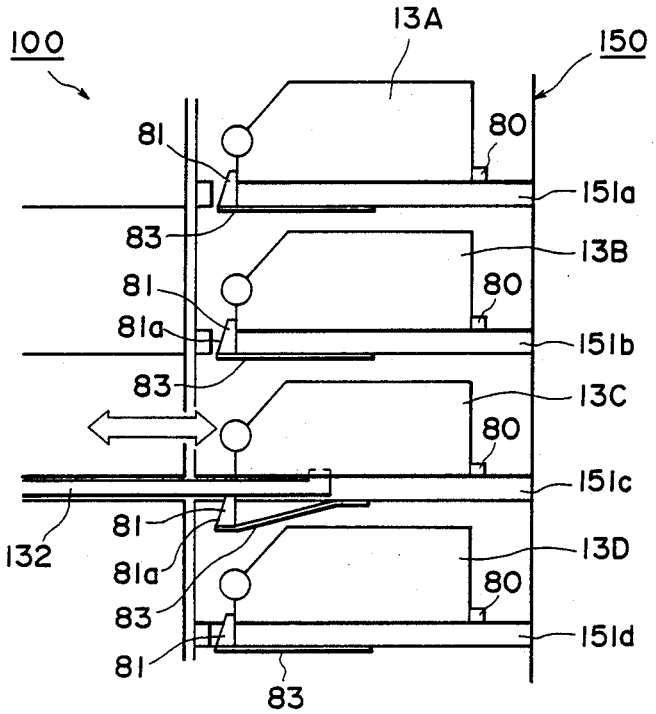
FIGS. 14 15A, 15B and 15C illustrate relationship between confinement and horizontal movement of the developing apparatus.

Referring to FIG. 14, the stopper mechanism includes a leaf spring member 83 for urging the developing device substantially upwardly, a stopper 81 having a trapezoidal cross section and fixed to an end of the leaf spring member 83 and a stopper 80 for abutment to the rear end of the developing device. The trapezoidal cross section of the stopper 81 provides a tapered surface 81*a* thereon which is inclined upwardly toward the inside of the accommodating apparatus.

The stopper mechanism is provided for each of the partition stages 151*a*–151*d*. The stoppers 80 and 81 serve to prevent the developing devices from moving in a horizontal direction, so that the developing devices are fixedly supported in the accommodating apparatus 150.

Figure 2:
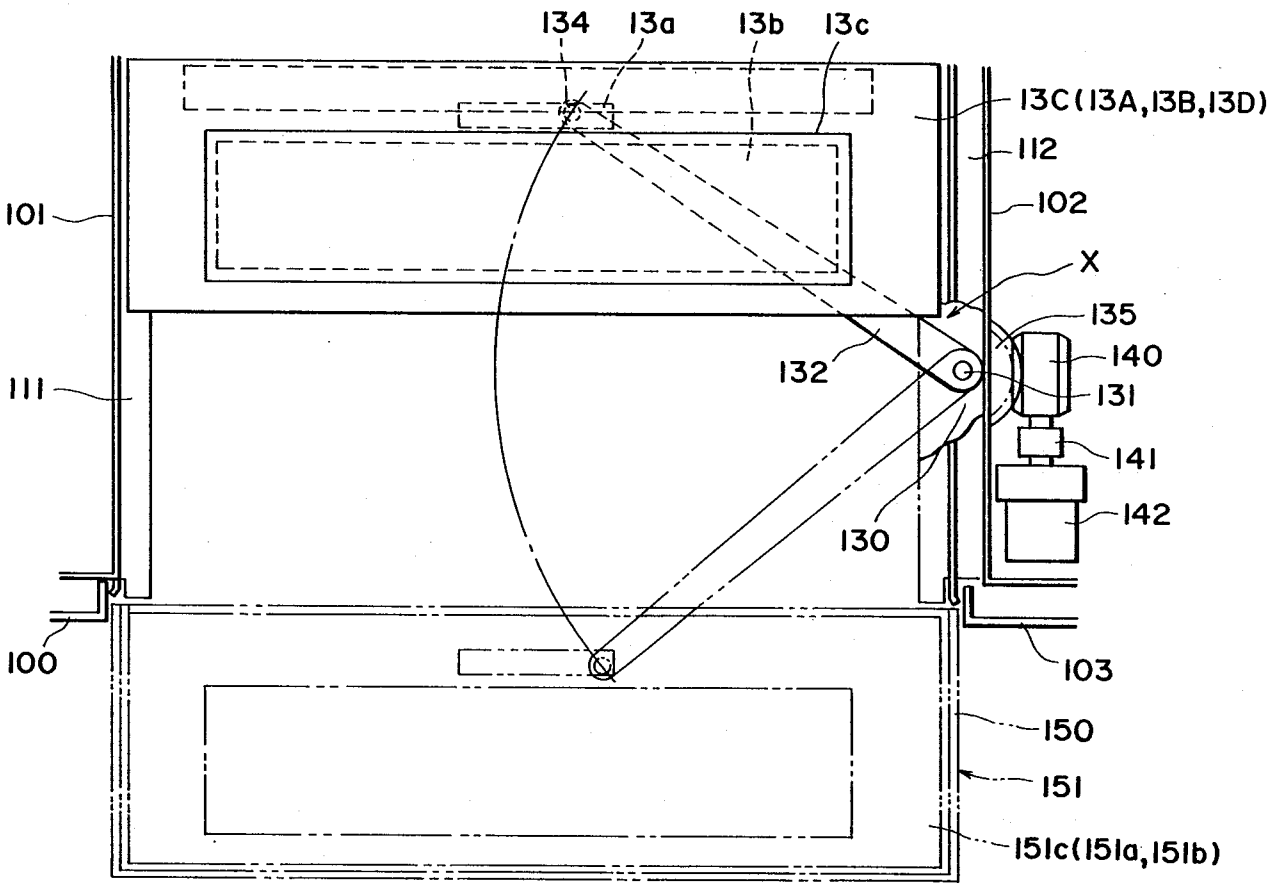
FIG. 2 is a partial top plan view of the image forming apparatus illustrating a developer moving means.

An arm 132 extends along the conveying passage from the main part 100 of the apparatus, as shown in FIG. 2. The arm 132 moves rightwardly in FIG. 14, by which the right-hand end is engaged to the tapered surface 81*a* of the stopper 81 to lower the stopper 81 as shown, so that the developing device 13C is released from the locking prevention by the stopper 81 in the conveying direction to allow the developing device 13C to move to the image forming position in the neighborhood of the photosensitive drum 11 (FIG. 1). When the developing device 13C is returned to the accommodating apparatus 150 after being used for the image formation, the rear end of the developing device 13C is engaged to the tapered surface 81*a* of the stopper 81 to lower the stopper 81 so as to allow the developing device 13C to be returned to the predetermined position in the accommodating apparatus 150. Instantaneously, the engagement between the developing device 13C and the stopper 81 is released with the result that the stopper 81 is raised by the spring force of the leaf spring 83, thus locking the developing device 13C, again. It is a possible alternative to drive the arm 132 prior to the returning of the developing device 13C to lower the stopper 81.

Therefore, even if the accommodating apparatus 150 is operated or externally vibrated, the developing device position is not deviated, whereby the developing device can be smoothly supplied to the image forming position when it is required, and the photosensitive drum 11 surface is not damaged. Particularly, in the apparatus of the type wherein the developing device is mountable into the accommodating apparatus or wherein the developing device can be supplied with the developer when it is mounted in the accommodating apparatus, the conveyance of the developing device or the supply of the developer is disabled due to the deviation of the developing device position, or the developer is scattered in the accommodating apparatus. Those problems can be prevented, according to this embodiment.

Figure 15A:
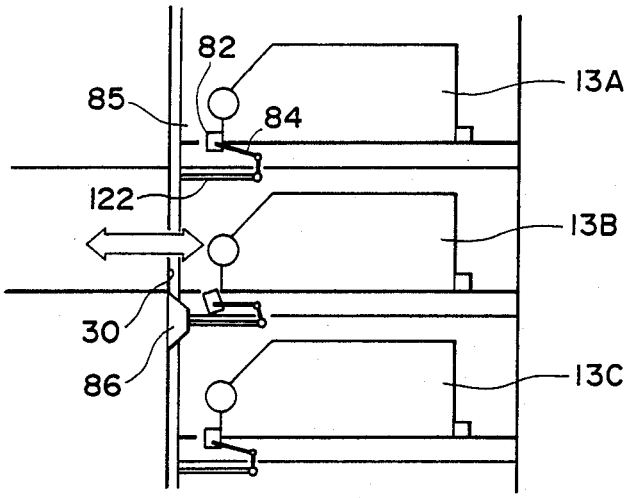

Referring to FIG. 15A, the stopper mechanism includes a lever 122 urged in one direction by a spring 85, a link 84 connected to the lever 122 and a stopper 82 mounted on an end of the link 84. Correspondingly, there is provided a projection 86 in the developing device inlet 30 of the main part 100 of the apparatus, the projection 86 having a trapezoidal cross section.

When the accommodating apparatus 150 lowers, as shown in FIG. 15A, to position the developing device 13B at a level where it can be conveyed out, and when the driving means is about to be actuated, the projection 86 is engaged to a end of the lever 122 of the stopper mechanism to push the lever 122 toward the inside of the apparatus, whereby the stopper 82 is pivoted counterclockwisely through the link 84, thus unlocking the developing device 13B in the movement in the conveying direction. On the other hand, the other developing devices 13A and 13C are locked and prevented from movement. In this manner, the problems arising from the positional deviation of the developing devices are solved.

In place of the projection 86, use can be made with a solenoid provided with a plunger which extends out of the main part 100 to push the lever 122 into the accommodating apparatus 150 only when the locking is to be released. In tis case, the solenoid is energized only when the developing device is to be conveyed, so that the positional accuracy of the developing device in the accommodating apparatus 150 before the conveyance thereof can be improved.

Figure 15B:
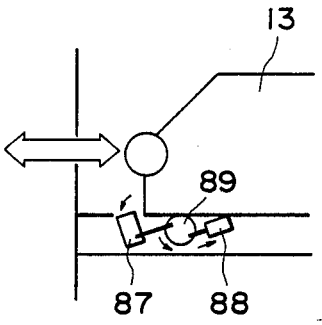

In FIG. 15B, the stopper 87 is switched by the solenoid 88. A rotor 89 is rotated by a solenoid 88, and is provided with a lever to which a stopper 87 is fixed.

Figure 15C:
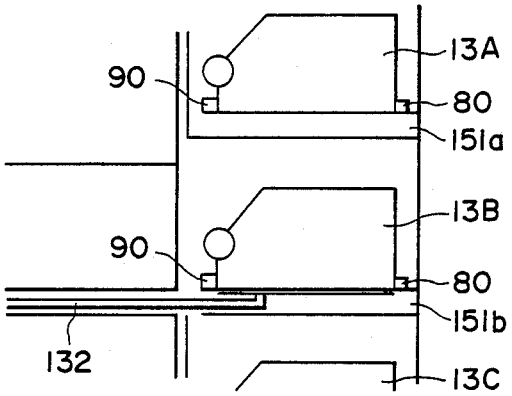

In FIG. 15C, the developing device secured by the front and rear stoppers 90 and 80 is released from the securing by shifting the stoppers 90 and 80 upwardly. The lever 132 has a surface for abutment with the developing device which is equivalent or smaller than the bottom surface portion of the developing device between the stoppers 90 and 80 in the areas. The developing device is shifted upward by the abutment surface.

Figure 16:
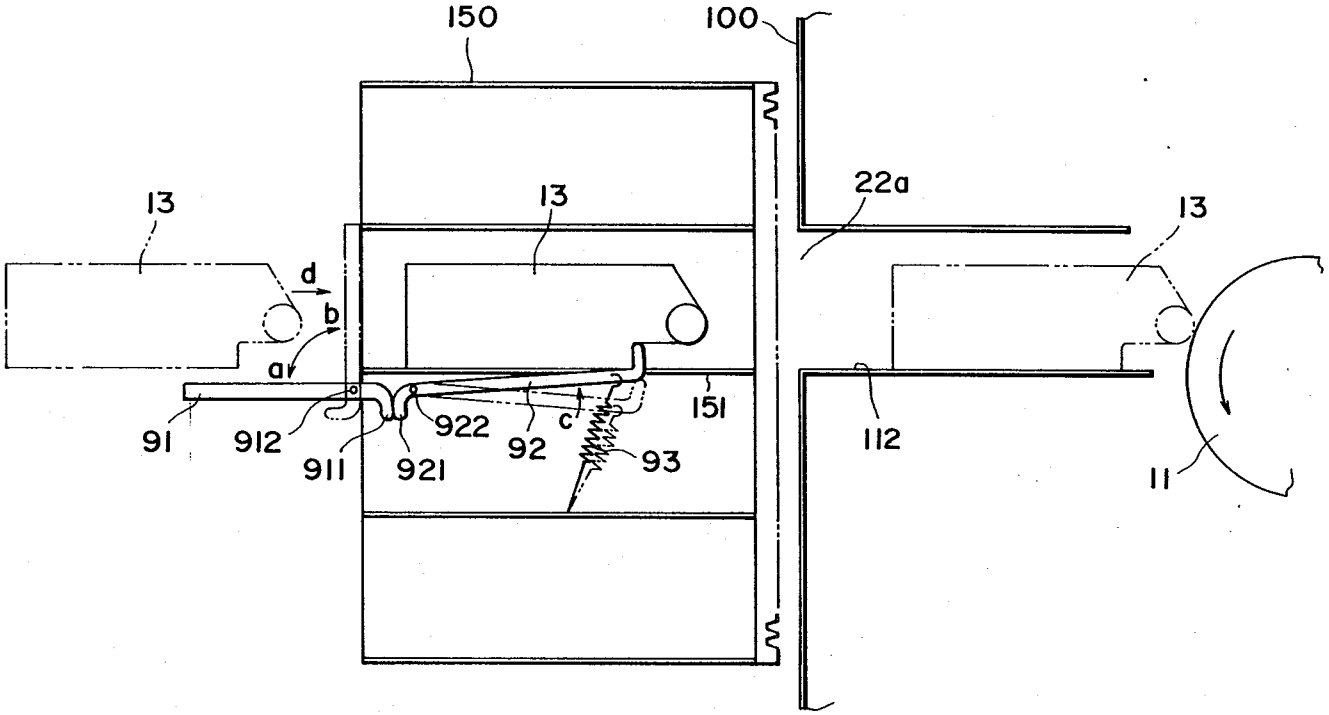
FIGS. 16–20 illustrate structures for allowing loading of the developing devices.
Figure 18:
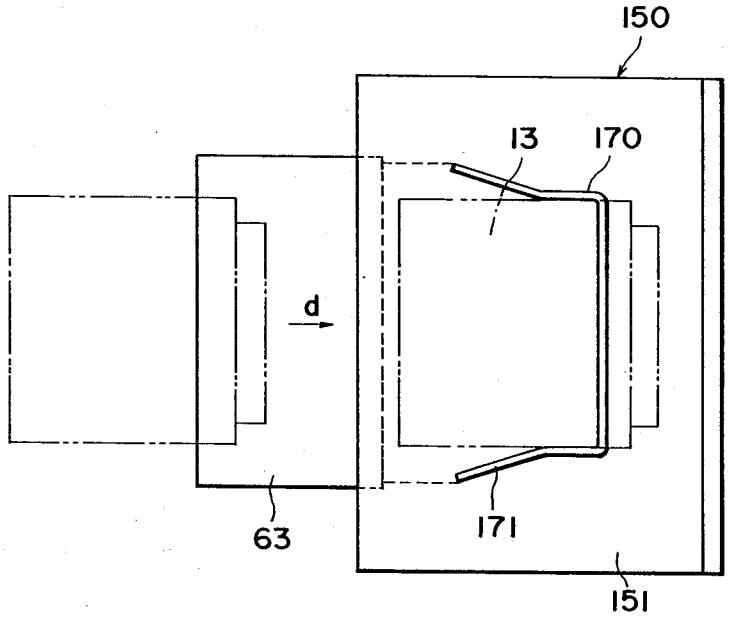

Referring to FIGS. 16 and 18, a solution to the problem in loading the developing device into the accommodating apparatus 150 is solved. In FIG. 16, the developing device accommodating apparatus 150 is provided with a door 91 for allowing the developing devices to be loaded into the apparatus 150 and a member 8*b* which is movable in interrelation with opening or closing of the door 91 and which serves to align the leading end of the developing device and also to stop the leading edge thereof. In response to the opening of the door 91, the member 8*b* projects out, while in response to the closing action of the door, the member 8*b* is retracted. By this, the developing device can be correctly loaded into the accommodating apparatus 150 at a predetermined position with precision, so that the developing device can be conveyed smoothly, leading to high quality images produced.

In FIG. 16, the conveyance passage 112 and the inlet 22*a* of the main part 100 are the same as described hereinbefore, and the door 91 for allowing manual loading of the developing device is disposed opposed to the conveyance passage 112 and the inlet 22*a*.

The door 91 which is opened when the accommodating apparatus 150 is loaded or unloaded with the developing device 13, is rotatably mounted on the apparatus 150 at an end thereof by a shaft 912. An end of the door 91 is formed into an arcuated end to constitute an engageable portion 911, as shown in FIG. 16.

Below the partition 151 for supporting the developing device 13 in the accommodating apparatus 150, there is a guide member 92 having an end adjacent to which it is rotatably (upward and downward) mounted by a shaft 922. An end of the guide member 92 is arcuated downwardly to constitute an arcuated engageable portion 921, and the other end is formed into a stopper 8*b* rising upwardly at right angles. On the guide member 92, guides 170 and 171 continuous with the stopper 8*b* are formed, as shown in FIG. 18. The guides 170 and 171 are constituted by parallel portions 170 spaced by a distance substantially equal to the width of the developing device 13 and a tapered portion 171 expanded outwardly and connected to the parallel portions 170, respectively. The guide member 92 is normally urged in one direction (clockwise direction) by a spring 93.

As shown in FIG. 16 by chain lines, when the door 91 is closed, the engagement portion 911 of the door 91 and the engagement portion 921 of the guide member 92 are spaced apart, so that they are not engaged, and therefore, the guide member 92 is placed below the partition stage 151 and is retracted from the space through which the developing device passes, by the spring 93 independently of the door 91.

When the developing device 13 is loaded into the accommodating apparatus 150, door 91 is rotated about the shaft 912 in the direction indicated by an arrow a in FIG. 16 to open it as shown by solid lines in this Figure. Then, the engagement portion 911 of the door 91 is engaged to the engagement portion 921 of the guide 92 to rotate the guide member 92 in the direction indicated by an arrow c about the shaft 922 against the spring force by the spring 93 to a position shown by solid lines. As a result, the stopper portion **8*b* of the guide member 92 is projected into the space above the partition stage 151. Therefore, by inserting the developing device 13 through the opening opened by the door 91 in the direction indicated by an arrow d, the developing device 13 is guided by the guiding portion 171 of the guide member 92 and is loaded into the apparatus 150. It should be noted that the parallel guiding portions 170 are effective to align the developing device 13 with the conveying direction from the apparatus 150 to the main part 100**.

When the developing device 13 is inserted to such an extent that a recess formed at an end thereof abuts the stopper **8*b* of the guide member 92, the developing device 13** is correctly loaded at the predetermined position.

Thereafter, the door 91 is closed by rotating it in the direction indicated by an arrow b in FIG. 16, the engagement between the engagement portion 911 of the door 91 and the engagement portion 921 of the guide member 92 is released, so that the guide member 92 is retracted by the spring 93 to the position indicated by chain lines, and the stopper portion **8*b* of the guide member 92 is lowered to below the partition stage 151, thus allowing movement of the developing device 4**.

Figure 19:
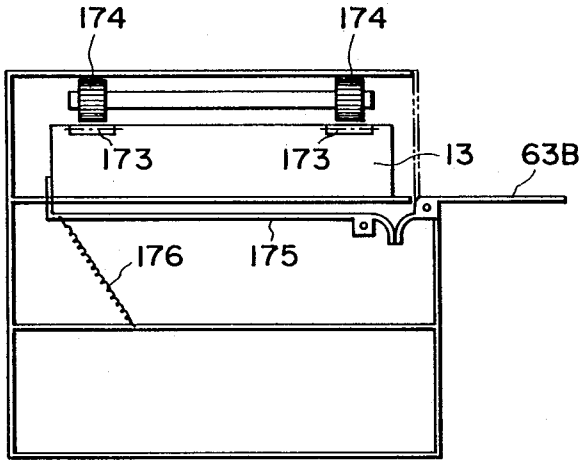

In the foregoing example, the developing device 13 is loaded into the accommodating apparatus 150 through a side part (left-hand side in FIG. 16) as viewed by the operator standing in front. However, the structure may be such that the developing device 13 is inserted through the front side (perpendicularly to the sheet of drawing of FIG. 16) with the above described structure incorporated (FIG. 19). Another mechanical structure can be adopted to perform the same functions, using a combination of a door and a member shifted in association with opening and closing of the door (FIG. 20).

FIG. 19 shows another embodiment and is a side view seen in the direction of moving the developing device from the accommodating apparatus into the main part of the image forming apparatus. On the top surface of the developing device 13 racks 173 are formed and are engageable with drive transmission gears 174, which is normally retracted above out of engagement with the rack 173. The accommodating apparatus shown is provided with a door 63B. Similarly to FIG. 16, a stopper member 175 is controlled to be projected or retracted with respect to the partition stage by cooperation between a spring 176 and the door 63B.

Figure 20:
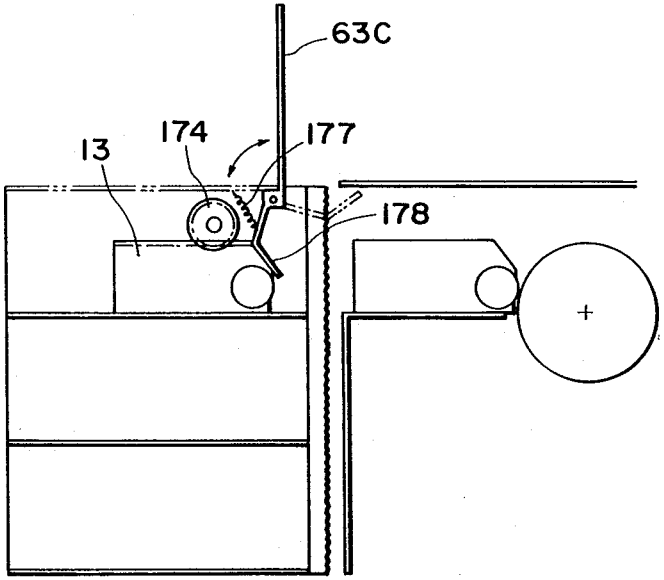

In FIG. 20, the developing device can be loaded in the same direction as in FIG. 16 even when the drive transmission gear 174 takes its upper position. More particularly, a door 63C is provided on the top surface of the accommodating apparatus, and a stopper member 178 is formed integral with the door 63C as an extension thereof to stop the leading end of the developing device, as will be understood from FIG. 20.

Figure 17:
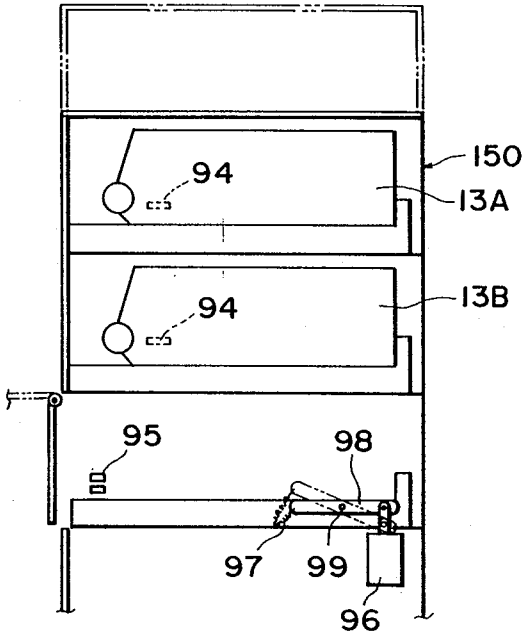

FIG. 17 shows a further embodiment, by which a problem in a relation between the developing device loading and the automatic exchange of the developing device after the loading, can be solved. More particularly, it is liable that after a developing device is transported from the accommodating apparatus into the main part of the image forming apparatus, another developing device is inadvertently loaded into the vacant space produced by the transportation. According to this embodiment, the liability is removed so as to accomplish a stabilized automatic exchange of the developing devices in an image forming apparatus.

According to this embodiment, after the developing device is transported or supplied into the main part, a stopper member of a stopping mechanism is projected into the resultant vacant space in the accommodating apparatus. When the developing device is returned from the main part into the accommodating apparatus, the above described stopper is retracted, and therefore, the necessary movement of the developing device is not obstructed by the stopper mechanism.

A photointerruptor 95 is provided for each of the developing device accommodating portions in the accommodating apparatus 150 at a side thereof, as shown in FIG. 17. Correspondingly, each of the developing devices (green developing device 13C, for example) is provided at a side thereof with a projection 94 for interrupting the optical path of the photointerruptor 95. The developing device accommodating portions are each provided with a stopper mechanism, as shown in FIG. 17.

The stopper mechanism includes a lever 98 journalled on a shaft 99 in the middle portion thereof for swinging movement (upward and downward), a solenoid 96 connected to an end of the lever 98, a spring 97 connected to an end of the lever 98 to normally urge the lever 98 in one rotational direction to maintain it at the solid line position shown in FIG. 17.

When, for example, a green developing device is selected, the entire developing device accommodating apparatus 150 is moved upwardly or downwardly by an unshown driving means, until the green developing device is brought into alignment with the inlet of the main part 100 for receiving the developing device With the alignment, the accommodating apparatus 150 is stopped. Subsequently, the green developing device is transported into the main part 100 by an unshown conveying means. Prior to the projection 94 of the green developing device interrupting the optical path of the photointerruptor 95, the solenoid 96 of the stopper mechanism is deenergized, so that the lever 98 is in the retracted position by the spring 97 as shown in FIG. 17 by solid lines.

When the projection 94 of the green developing device 13C passes through the optical path of the photointerruptor 95, vacant space is formed in the accommodating apparatus 150 as shown in FIG. 17. When the projection 94 passes across the optical path of the photointerruptor 95, the solenoid 96 is energized in response to the signal from the photointerruptor 95. When the solenoid 96 is energized, it rotates the lever 98 about the shaft 99 in the clockwise direction against the spring force of the spring 97 so as to project a part of the lever 97 into the vacant space as indicated by broken lines in the Figure.

In this embodiment, the developing device is loaded from the front side toward the rear side of the accommodating apparatus 150, in other words, perpendicularly to the sheet of the drawing of FIG. 17. As described, the lever 97 is projected into the vacant space so as to prohibit another developing device other than the green developing device 13C which has been transported into the main part from being loaded into the vacant space, whereby the possibility of disabling the automatic exchange of the developing devices can be avoided.

Upon the green developing device 13C to be returned into the empty space of the accommodating apparatus 150 from the main part 100, when the projection 94 of the green developing device 13C passes across the optical path of the photointerruptor 95, the solenoid 96 is deenergized. By this, the lever 98 which has been maintained at the broken line position in FIG. 17 is retracted back to the solid line position by the spring 34, by which the green developing device 13C can be returned to the predetermined position in the accommodating apparatus 150 without obstruction.

Referring to FIGS. 21–24, there is shown a further preferred embodiment. In this embodiment, the driving mechanism for transporting the developing device in a horizontal plane is the same as shown in FIG. 7. The vertical movement of the accommodating apparatus is performed by the cooperation between the worm gear 114 and the rack 115 of the accommodating case as shown in FIG. 6. Therefore, the developing device employed in this embodiment is provided with projections from both sides thereof for the horizontal guide as shown in FIG. 6, and the projections are provided with rack 511 for receiving driving force from the gear 51.

The main part 100 of the image forming apparatus is provided with a guiding rail 67 having an expanded receiving portion for receiving the above described projection of the developing device when it is transported from the accommodating apparatus 150. The guide rail 67 has an end 671 which is formed into a stopper for abutment to a projection 511A of the developing device to locate it at the operative position of development of the developing device. The developing device shown by broken lines in FIG. 21 is illustrated as being positioned at a stand-by position. The guiding rail 67 is provided on the top surface adjacent opposite sides thereof in the space of the developing device transportation passage in the main part 100 of the image forming apparatus.

The developing device accommodating apparatus 150 mountable to the main part 100 of the image forming apparatus includes connecting projections 211 and 211 for engagement with the main part 100 at upper and lower positions from the developing device transportation passage, an assisting plate 24 for assisting the horizontal movement of the developing device, guiding rails 65 and 66 for guiding the projection of the developing device, stoppers 56 and 57 engageable with the rear and front ends of the developing device, releasing mechanism constituted by elements 55, 60, 61, 58, 59 and 62 for releasing the stopping operation of the stoppers 56 and 57 and a door 63 for allowing the developing device to be loaded into the apparatus 150 and an assisting member 64 for assisting the loading of the developing apparatus. The accommodating apparatus 150 is capable of accommodating three developing devices 13A, 13B and 13C in the accommodating case which is movable substantially vertically. In the Figure, the developing device 13B is illustrated as being located at the loading position and the automatic transporting position. The housing of the accommodating apparatus 150 is large or high enough to allow the accommodating case to move by one stage upwardly and downwardly. The projection with the rack of the developing device is disposed between the upper guide 65 and the lower guide 66 mounted on the accommodating portion, although the upper and lower guides are not shown for the developing devices 13A and 13C for the sake of simplicity.

The upper and lower guides 65 and 66 perform functions which is similar to that of the expanded portion 272 in FIG. 5, more particularly to positively receive the rack 511 and guide it, so as to stably transport the developing device. More particularly, the upper guide 652 and the lower guide 662 of the accommodating apparatus 150 are tapered upwardly and downwardly, respectively at the ends, as shown in FIG. 21. The upper and lower guides of the main part 100 are correspondingly tapered as shown in this Figure. It is preferable that those guides 65 and 66 are also tapered in the lateral directions with respect to the transportation direction, as shown in FIG. 18. The upper and lower guides 65 and 66 each have the length only enough to accommodate the developing device, since otherwise the weight of the accommodating apparatus 150 increases with the result that the required torque for the vertical movement of the accommodating apparatus 150 is increased, which will lead to bulkiness of the apparatus. Because the guiding rails are made compact, the distance between the guiding rail 67 of the main part 100 and the upper and lower guides 65 and 66 of the accommodating apparatus 150 is relatively large, with the result of unstable transfer of the developing device therebetween. To obviate this problem, an assisting plate 24 for supplementarily guiding the projection with the rack 511 of the developing device is disposed along the passage for the automatic exchange of the developing device. The guiding plate 24 is tapered downwardly at the front and rear ends thereof. By doing so, the horizontal movement of the developing device can be further stabilized.

The stoppers 57 and 56 of the stopper mechanism for the developing device are each in the form of a pawl which projects to the bottom side of the rack 511 of the developing device and which has a portion tapered upwardly away from the developing device stopped thereby. Two of such stoppers 57 are provided adjacent opposite lateral ends of the developing device near the main part 100 and are fixed to a common shaft. Similarly, two of such stoppers 56 are provided adjacent opposite lateral sides of the developing device at the rear end thereof and are fixed to a common shaft. The stoppers 56 and 57 are maintained at the positions indicated in the Figure by their own weight, but are easily shifted upwardly when a force is applied to the tapered portion by the moving developing device to allow the developing device to enter the accommodating apparatus 150. However, the stopping surfaces of the stoppers 56 and 57 prevent the developing device from moving out of the accommodating apparatus 150 beyond the stoppers. In this manner, the developing device is locked by the stoppers 56 and 57 and is guided at the projections by the upper and lower rails 65 and 66, so that it is completely supported and fixed without positional deviation. A stopper releasing mechanism is operated when the developing device is automatically transported. The stopper releasing mechanism include releasing levers 55 and 55 associated to the stoppers 56 and 57, respectively. The releasing levers 55 and 55 are securedly fixed to a rotational shaft rotatably supported by the housing of the accommodating apparatus 150. The releasing levers 55 and 55 are controlled in their rotations by gears 60 which are symmetrically arranged with respect to a solenoid 58 and gears 61 meshed with the gear 60. The gears 61 are fixed to respective end portions of the shafts. A movable plate 59 which is movable substantially vertically by the solenoid 58 is normally urged upwardly in FIG. 23 by a tension spring 62. When a releasing signal is produced, the solenoid 58 is energized in FIG. 23 so as to lower the movable plate 59, by which the gear 60 moves up, and simultaneously, the gear 61 meshed therewith moves upwardly. Therefore, the releasing levers 55 shift the stoppers 56 and 57 upwardly simultaneously so as to retract the stoppers 56 and 57 away from the space through which the developing device is movable in a horizontal plane. By this, the developing device is allowed to be automatically transported out of the accommodating apparatus 150. The automatic transportation is performed under the above described control and by the above described structures.

On the contrary, when the developing device is returned from the main part 100 into the accommodating apparatus 150, the developing device being driven toward the accommodating apparatus 150 pushes the releasing levers 55 and 55 upwardly from the position shown in FIG. 21 and also lifts the stopper 57 along the tapered surface thereof and moves until the rear end of the developing device abuts the stopping surface of the stopper 56. Then, the stopper 57 is no longer urged by the developing device, and therefore it falls by its weight with the aid of the spring 62 to fix the front end of the developing device. When the developing device is to be loaded into the accommodating apparatus 150, the developing device being loaded is engaged to the tapered surface of the releasing lever 55 and pushes it upwardly, and further lifts the tapered surface of the stopper 56, and therefore, it is inserted into the apparatus 150 until the front end of the developing device abuts the stopping surface of the stopper 57, whereupon the developing device is prevented from further being inserted. If there were no stopping action like the stoppers 57, the developing device would inadvertently reach the boundary between the main part 100 and the accommodating apparatus 150, with the result that the developing device could not be fixedly supported. If this occurred, the developing device could be damaged. When the developing device is stopped by the stoppers 57, the stoppers 56 and the lever 55 fall to fixedly support the rear end of the developing device. The housing of the accommodating apparatus 150 is provided with a door 63 for allowing the developing device loading only to the accommodating portion of the accommodating apparatus 150 which is opposed to the transportation passage of the main part 100 of the image apparatus. The door 63 is provided at its inside with a jig 64 slidably supported thereon. The jig 64 is U-shaped and is used to insert the developing device into the apparatus 150.

When the developing device is loaded into the apparatus 150, the door 63 is opened, and the jig 64 is pulled as depicted by reference 64A in FIG. 21. The developing device is placed on the inside surface of the door 63 (63A), as shown by chain lines at the lefthand part of FIG. 21. At this time, the cover 63 is parallel to the upper and lower rails 65 and 66 to assist the loading of the developing device. Then, the developing device thus placed is pushed by the jig 64A until the developing device is confined by the stoppers 56 and 57 in the manner described in the foregoing. Subsequently, the door 63 is closed, and then, the automatic control of the accommodating apparatus 150 is enabled.

The apparatus may be modified such that the developing device confined by the stoppers 56 and 57 are automatically conveyed out, when the door 63 is opened, on the inside surface of the door 63 for the purpose of easier manipulation by the operator. This control may be accomplished by performing the reverse rotation of the gear of FIG. 7 and operating the solenoid 58 of the stopper mechanism (FIG. 23) in response to a signal 300 for instructing the removal of the developing device on the operation panel, provided that the door is opened and that the developing device is confined by the stoppers 56 and 57 within the accommodating apparatus 150. In the modified arrangement, the jig 64 functions as a stopper for limiting the discharging movement of the developing device.

Figure 24:
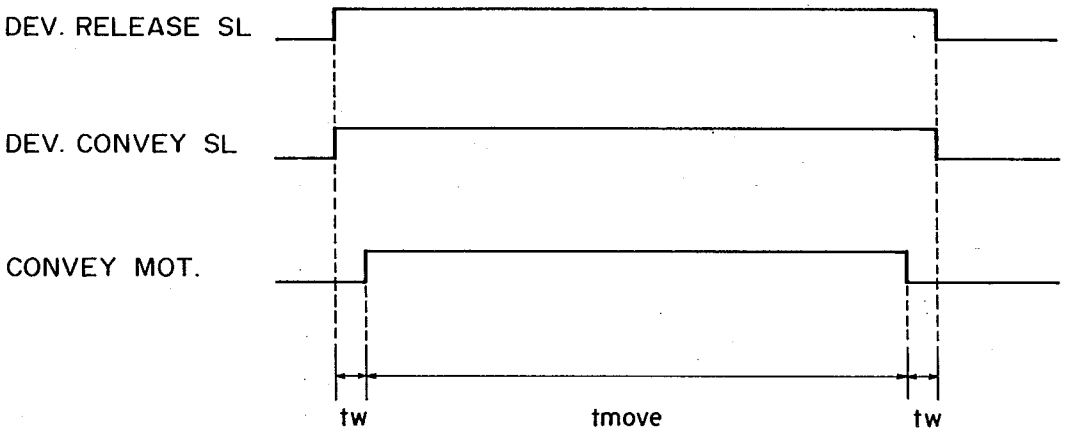
FIG. 24 is a timing chart illustrating operational timing of the apparatus of FIG. 23.

FIG. 24 illustrates the operation timing. The solenoid 58 (FIG. 23) and the developer conveying solenoid 76 (FIG. 7) are actuated simultaneously, and by the solenoids, the driving force is transmitted only to the developing device which is allowed to move. At the time of stoppage of the developing device, the retraction of the gear 51 and the stoppage of the stopper releasing action are simultaneously performed after completion of the drive transmission. In the Figure, a time period $t_w$ corresponds to the rising time of the solenoids 58 and 76, and reference $t_{move}$ is an operating period of the conveying motor.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

accommodating means for accomodating a plurality of developing devices on movable stages and having first moving means for moving the developing devices in a predetermined direction intersecting a direction of movement of the stages; and an image formation assembly including a second moving means for receiving a said developing device moved out of said accommodating means and for further moving it in the predetermined direction, said image formation assembly including means for forming images using said developing device;

said accommodating means further including means for allowing a said developing device to be loaded into said accommodating means, said allowing means allowing said accommodating means to be hinged to expose such side of said accommodating means as is opposed to said moving means, thus allowing the loading of the developing device.

2. An apparatus according to claim 1, wherein said allowing means allows said accommodating means to be hinged to expose such a side of said accommodating means as is opposed to said second moving means, thus allowing the loading of the developing device.

3. An image forming apparatus, comprising:

accommodating means for accommodating a plurality of developing devices on movable stages and having first moving means for moving the developing devices in a predetermined direction intersecting a direction of movement of the stages; and an image formation assembly including a second moving means for receiving a said developing device moved out of said accommodating means and for further moving it in the predetermined direction, said image formation assembly including means for forming images using said developing device;

said accommodating means further including means for allowing a said developing device to be loaded into said accommodating means, said allowing means including a movable member to open or close an opening of said accommodating means formed in such a side of said accommodating means as is different from a side thereof opposed to said second means.

4. An apparatus according to claim 3, wherein the movable member includes a door for allowing the loading of the developing device in a direction substantially the same as movement direction of said developing device by said first and second moving means.

5. An apparatus according to claim 4, wherein said door, when it is opened, provides a surface for assisting the loading of the developing device.

6. An apparatus according to claim 5, wherein said accommodating means is provided with a stopper for engagement with the developing device to control movement of the developing device within said accommodating means, and wherein the door is interrelated with the stopper to operate the stopper in response to opening of the door and to disable the stopper in response to closing of the door.

7. An apparatus according to claim 3, wherein said second moving means includes a passage for conveying the developing device, and wherein the door closes or opens only the opening which is faced to the stage along an extension of the passage.

8. An apparatus according to claim 7, wherein the door is allowed to be opened only when a level of one of the stages are aligned with a level of a conveying passage in said image formation assembly for guiding the developing device.

9. An apparatus according to claim 8, wherein the door is provided with a member for assisting the loading of the developing device, the assisting member being movable relative to the door and being disposed inside said accommodating means when the door is closed, and being contactable to the developing device when the door is opened.

10. An apparatus according to claim 5, wherein the door is provided with a member for assisting the loading of the developing device, the assisting member being movable relative to the door and being disposed inside said accommodating means when the door is closed, and being contactable to the developing device when the door is opened.

11. An apparatus according to claim 7, wherein the developing device is provided with a drive receiving portion for receiving driving force from said first moving means, said drive receiving portion is projected from lateral sides of the developing device with respect to movement direction thereof, wherein said first moving means of said first accommodating means includes a first U-shaped guiding members for guiding the drive receiving portion and opened to apply the driving force to the drive receiving portion, and wherein said second moving means includes guiding members for receiving and guiding said drive receiving portions.

12. An apparatus according to claim 8, wherein the developing device is provided with a drive receiving portion for receiving driving force from said first moving means, said drive receiving portion is projected from lateral sides of the developing device with respect to movement direction thereof, wherein said first moving means of said first accommodating means includes a first U-shaped guiding members for guiding the drive receiving portion and opened to apply the driving force to the drive receiving portion, and wherein said second moving means includes guiding members for receiving and guiding said drive receiving portions.

13. An apparatus according to claim 7, wherein the developing device is provided with a drive receiving portion for receiving driving force from said first moving means, said drive receiving portion is projected from a top surface of said developing device adjacent lateral sides of the developing device with respect to movement direction thereof.

14. An apparatus according to claim 8, wherein the developing device is provided with a drive receiving portion for receiving driving force from said first moving means, said drive receiving portion is projected from a top surface of said developing device adjacent lateral sides of the developing device with respect to movement direction thereof.

15. An accommodating apparatus for accommodating a plurality of developing devices, comprising:

accommodating case having a plurality of partition stages, arranged in a predetermined direction for supporting the developing devices, said accommodating case being movable in the predetermined direction; and a housing for said accommodating case having an opening, in a first side thereof, for allowing the developing devices to be automatically supplied into an image forming apparatus with which said accommodating apparatus is used, and having an opening, in a second side thereof, which is different from the first side, for allowing the developing devices to be loaded into said accommodating case, said opening being provided with a door, and the loading of the developing device is permitted when the door is opened.

16. An apparatus according to claim 15, wherein the automatic supplying opening is opposed to a passage in the image forming apparatus for conveying the developing device, and said loading opening is disposed along an extension of the passage.

17. An apparatus according to claim 16, wherein the door, when it is opened, constitutes a guiding surface for assisting the loading of the developing device; and the door is provided with an assisting member movable relative to the guiding surface and engageable to the developing device.

18. An accommodating apparatus for accommodating a plurality of developing devices, comprising:

an accommodating case having a plurality of partition stages, arranged substantially vertically, for supporting developing devices, said accommodating case is vertically movable; and securing means having plural securing members for securedly accommodating the developing devices in the accommodating case, said securing member being movable into and away from a passage for horizontal movement of the developing devices, and said securing members securing a front and rear side of each of the developing devices with respect to the horizontal movement thereof toward outside of said accommodating apparatus.

19. An apparatus according to claim 18, wherein said securing members are provided at the front side adjacent to lateral ends with respect to a direction of the horizontal movement of the developing device, and are provided at the rear end of the developing device adjacent the lateral ends of the developing device.

20. An apparatus according to claim 18 further comprising control means for actuating said securing members simultaneously, for the developing device to be moved.

21. An apparatus according to claim 19, further comprising control means for actuating said securing members simultaneously, for the developing device to be moved.

22. An apparatus according to claim 20, wherein said control means releases the developing device from the securing by said securing means before the developing means associated with the securing means is supplied with driving force for the horizontal movement.

23. An apparatus according to claim 21, wherein said control means releases the developing device from the securing by said securing means before the developing means associated with the securing means is supplied with driving force for the horizontal movement.

24. An apparatus according to claim 18, wherein said securing means is restricted from the passage in association with the loading of the developing device into said accommodating apparatus.

25. An apparatus according to claim 22, wherein the transmission of the driving force and the releasing operation of said control means are performed with respect to the developing device accommodated opposed to an opening, of said casing, for allowing automatic conveyance of the developing device.

26. An accommodating apparatus for accommodating a plurality of developing devices, comprising:

a passage for guiding movement in a predetermined direction to guide projections of a developing device projected from lateral sides, said projections are provided with portions for receiving driving forces; and means for transmitting driving forces to the drive receiving portion of the projection disposed in said passage.

27. An apparatus according to claim 26, wherein said transmitting means is disposed to be actable on the developing device disposed at a position for movement into an image forming apparatus with which said accommodating apparatus is used.

28. An apparatus according to claim 27, further comprising a casing having an opening for allowing the developing device to be loaded into said apparatus from outside thereof, and wherein said opening is formed corresponding to the guiding portion of said image forming apparatus.

29. An apparatus according to claim 26, further comprising means for moving the plurality of developing devices substantially vertically, and control means for controlling said transmitting means and said moving means.

30. A developing device usable with an apparatus provided with means for moving the developing device in a predetermined direction, comprising:

a main assembly containing means for developing an image, said main assembly having lateral sides with respect to a direction of movement; and projections from a lateral side or sides of said developing device, said projection having a drive receiving portion to which driving force is transmitted from the moving means, said projections being guided along guiding members in said apparatus.

31. A device according to claim 30, further comprising additional drive receiving portions formed on a top side of said developing device adjacent lateral ends thereof.

* * * * *

UNITED STATES PATENT AND TRADEMARK OFFICE

CERTIFICATE OF CORRECTION

PATENT NO. : 4,841,329

DATED : June 20, 1989

INVENTOR(S) : TOSHIROU KASAMURA, ET AL.

It is certified that error appears in the above-identified patent and that said Letters Patent is hereby corrected as shown below:

IN [57] ABSTRACT

Line 12, "a" should be deleted.

COLUMN 1

Line 38, "or demounting" should read --or demount--.
Line 54, "system" should read --systems--.
Line 55, "involves" should read --involve--.
Line 57, "that" should read --of--.
Line 62, "becoming" should read --becomes--.
Line 67, "handle" should read --handled--.

COLUMN 2

Line 36, "therein t" should read --therein to--.
Line 47, "as" should read --as a--.

COLUMN 3

Line 26, "device." should read --devices.--.
Line 54, "relationship" should read --relationships--.

COLUMN 4

Line 20, "a" should be deleted.
Line 62, "advanced to" should read --advances to--.

--

UNITED STATES PATENT AND TRADEMARK OFFICE

CERTIFICATE OF CORRECTION

PATENT NO. : 4,841,329

DATED : June 20, 1989

INVENTOR(S) : TOSHIROU KASAMURA, ET AL.

It is certified that error appears in the above-identified patent and that said Letters Patent is hereby corrected as shown below:

COLUMN 5

Line 17, "a" should be deleted.
Line 27, "mode" should read --mode.--.
Line 28, "mod" should read --mode--.

COLUMN 6

Line 4, "mod" should read --mode--.
Line 10, "43 and 44" should read --43 and 44.--.
Line 37, "be" should be deleted.

COLUMN 7

Line 11, "u and down" should read --up and down--.
Line 30, "will b" should read --will be--.

COLUMN 8

Line 7, "surface" should read --surface.--.
Line 21, "a" (second occurrence) should read --an--.
Line 58, "lack 115" should read --rack 115--.

COLUMN 9

Line 30, "de eloping" should read --developing--.
Line 53, "for red" should read --is red--.

COLUMN 12

Line 24, "lack 511" should read --rack 511--.
Line 27, "lack 511" should read --rack 511--.

--

UNITED STATES PATENT AND TRADEMARK OFFICE

CERTIFICATE OF CORRECTION

PATENT NO. : 4,841,329

DATED : June 20, 1989

INVENTOR(S) : TOSHIROU KASAMURA, ET AL.

It is certified that error appears in the above-identified patent and that said Letters Patent is hereby corrected as shown below:

COLUMN 15

Line 44, "locking means 8" should read --locking means 68--.

COLUMN 16

Line 1, "photosensitive drum 1" should read --photosensitive drum 11--.

COLUMN 18

Line 43, "from the predetermined" should be deleted.

COLUMN 19

Line 30, "stopper 81 )" should read --column 81 so--.

COLUMN 22

Line 54, "device" should read --device.--.

COLUMN 26

Line 52, "accomodating" should read --accommodating--.

COLUMN 27

Line 52, "are" should read --is--.

--

UNITED STATES PATENT AND TRADEMARK OFFICE

CERTIFICATE OF CORRECTION

PATENT NO. : 4,841,329

DATED : June 20, 1989

INVENTOR(S) : TOSHIROU KASAMURA, ET AL.

It is certified that error appears in the above-identified patent and that said Letters Patent is hereby corrected as shown below:

COLUMN 28

Line 8, "members" should read --member--.
Line 20, "members" should read --member--.
Line 41, "accommodating case" should read --an accommodating case--.

COLUMN 29

Line 22, "claim 18" should read --claim 18,--.
Line 41, "restricted" should read --retracted--.

COLUMN 30

Line 38, "said projection" should read --said projections--.

Signed and Sealed this

Eighth Day of October, 1991

*Attest:*

HARRY F. MANBECK, JR.

*Attesting Officer*

*Commissioner of Patents and Trademarks*